US010394184B2

(12) United States Patent
Kurihara et al.

(10) Patent No.: US 10,394,184 B2
(45) Date of Patent: Aug. 27, 2019

(54) IMAGE FORMING APPARATUS WITH CONTACT-SEPARATION MECHANISM FOR IMAGE CARRIER

(71) Applicant: Oki Data Corporation, Tokyo (JP)

(72) Inventors: Kazuteru Kurihara, Tokyo (JP); Atsushi Ohta, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 16/134,066

(22) Filed: Sep. 18, 2018

(65) Prior Publication Data

US 2019/0094792 A1 Mar. 28, 2019

(30) Foreign Application Priority Data

Sep. 27, 2017 (JP) ..... 2017-185546

(51) Int. Cl.
*G03G 21/16* (2006.01)

(52) U.S. Cl.
CPC ..... *G03G 21/1647* (2013.01); *G03G 21/168* (2013.01); *G03G 21/1676* (2013.01)

(58) Field of Classification Search
CPC ..... G03G 21/1647; G03G 21/1676; G03G 21/168
See application file for complete search history.

(56) References Cited

U.S. PATENT DOCUMENTS

2007/0160388 A1* 7/2007 Yoshimura ..... G03G 21/1825 399/111
2010/0202797 A1* 8/2010 Kikuchi ..... G03G 21/1623 399/111
2010/0247198 A1* 9/2010 Saiki ..... G03G 21/1647 399/394
2012/0195627 A1* 8/2012 Kikuchi ..... G03G 21/1647 399/110
2012/0308273 A1* 12/2012 Kamimura ..... G03G 15/01 399/313
2014/0072332 A1* 3/2014 Kitamura ..... G03G 21/1633 399/107
2014/0140719 A1* 5/2014 Suzuki ..... G03G 15/0189 399/92
2015/0301497 A1* 10/2015 Kawanami ..... G03G 21/168 399/121
2015/0362890 A1* 12/2015 Komatsu ..... G03G 21/1623 399/110
2016/0349664 A1* 12/2016 Sawashima ..... G03G 21/1647

FOREIGN PATENT DOCUMENTS

JP 2014-123110 A 7/2014

* cited by examiner

*Primary Examiner* — David J Bolduc
(74) *Attorney, Agent, or Firm* — Panitch Schwarze Belisario & Nadel LLP

(57) ABSTRACT

An image forming apparatus includes an image carrier, a developer carrier disposed so as to face the image carrier, a transfer body disposed so as to face the image carrier, and a contact-separation mechanism. The contact-separation mechanism brings the developer carrier and the image carrier into contact with each other and separates the developer carrier and the image carrier from each other, and brings the image carrier and the transfer body into contact with each other and separates the image carrier and the transfer body from each other.

17 Claims, 20 Drawing Sheets

IMAGE FORMING APPARATUS WITH CONTACT-SEPARATION MECHANISM FOR IMAGE CARRIER

CROSS-REFERENCE TO RELATED APPLICATION

This application claims priority under 35 U.S.C. § 119(b) to Japanese Patent Application No. 2017-185546, filed Sep. 27, 2017, the disclosure of which is incorporated herein by reference in its entirety.

BACKGROUND OF THE INVENTION

1. Field of the Invention

The present invention relates to an image forming apparatus that forms an image by using electrophotography.

2. Description of the Related Art

The image forming apparatus using electrophotography forms a latent image on the surface of a photosensitive drum and forms a developer image by developing this latent image with a developing roller. The developer image formed on the surface of the photosensitive drum is transferred onto a transfer body (an intermediate transfer belt, for example).

If the developing roller is left in contact with the photosensitive drum for a long period of time, an indentation (a concave deformation) can appear on the surface of the developing roller. Accordingly, providing a contact-separation mechanism for bringing the developing roller into contact with the photosensitive drum and separating them has been proposed. For example, refer to Japanese Patent Application Publication No. 2014-123110 (FIGS. 3 and 4).

The photosensitive drum, however, is in contact also with the transfer body, and to suppress the wearing out of the photosensitive drum, the photosensitive drum needs to be brought into contact with and separated from the transfer body. If a mechanism for bringing the photosensitive drum into contact with the transfer body and separating them is provided in addition to the contact-separation mechanism for bringing the developing roller into contact with the photosensitive drum and separating them, the configuration of the image forming apparatus would become complicated.

SUMMARY OF THE INVENTION

An image forming apparatus according to the present invention includes an image carrier, a developer carrier disposed so as to face the image carrier, a transfer body disposed so as to face the image carrier, and a contact-separation mechanism configured to bring the developer carrier and the image carrier into contact with each other and separate the developer carrier and the image carrier from each other, the contact-separation mechanism being configured to bring the image carrier and the transfer body into contact with each other and separate the image carrier and the transfer body from each other.

BRIEF DESCRIPTION OF THE DRAWINGS

In the attached drawings.

DETAILED DESCRIPTION OF THE INVENTION

Further scope of applicability of the present invention will become apparent from the detailed description given hereinafter. However, it should be understood that the detailed description and specific examples, while indicating preferred embodiments of the invention, are given by way of illustration only, since various changes and modifications will become apparent to those skilled in the art from the detailed description.

First Embodiment (Configuration of Image Forming Apparatus)

Figure 1:
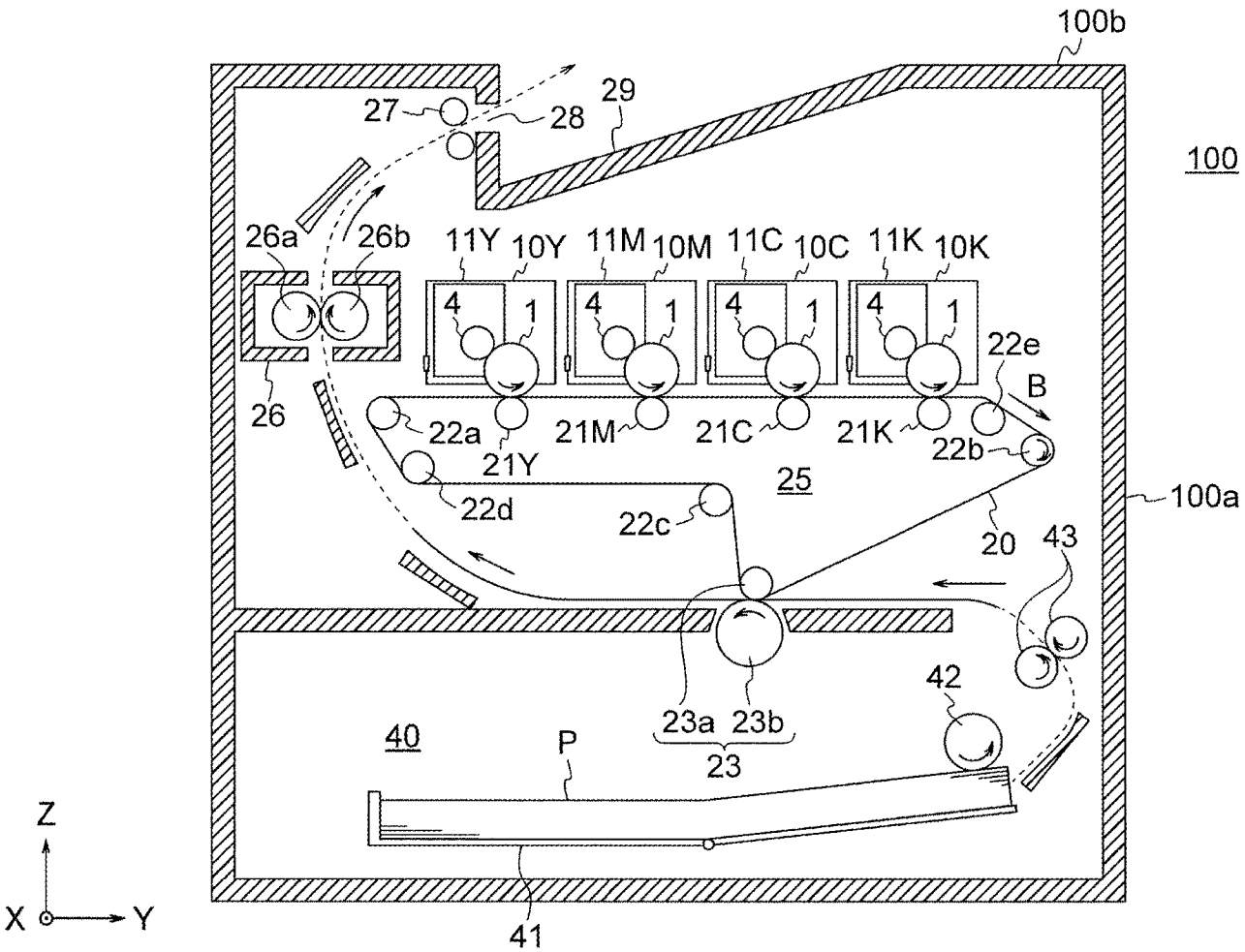
FIG. 1 is a diagram showing the overall configuration of an image forming apparatus of a first embodiment.

FIG. 1 is a diagram showing the basic configuration of an image forming apparatus 100 according to a first embodiment of the present invention. The image forming apparatus 100 forms an image by electrophotography, using yellow, magenta, cyan, and black toners (developers). Here, the intermediate transfer system is used as the transfer system, but the direct transfer system, for example, can also be used.

The image forming apparatus 100 includes a medium supply section 40 that supplies a recording medium P, process units 10Y, 10M, 10C, and 10K that form an image, a transfer belt unit 25 that transfers the image to the recording medium P, a fixing device 26 that fixes the image onto the recording medium P, and ejection rollers 27 that discharge the recording medium P. These components are disposed inside a housing 100*a* of the image forming apparatus 100.

Figure 11:
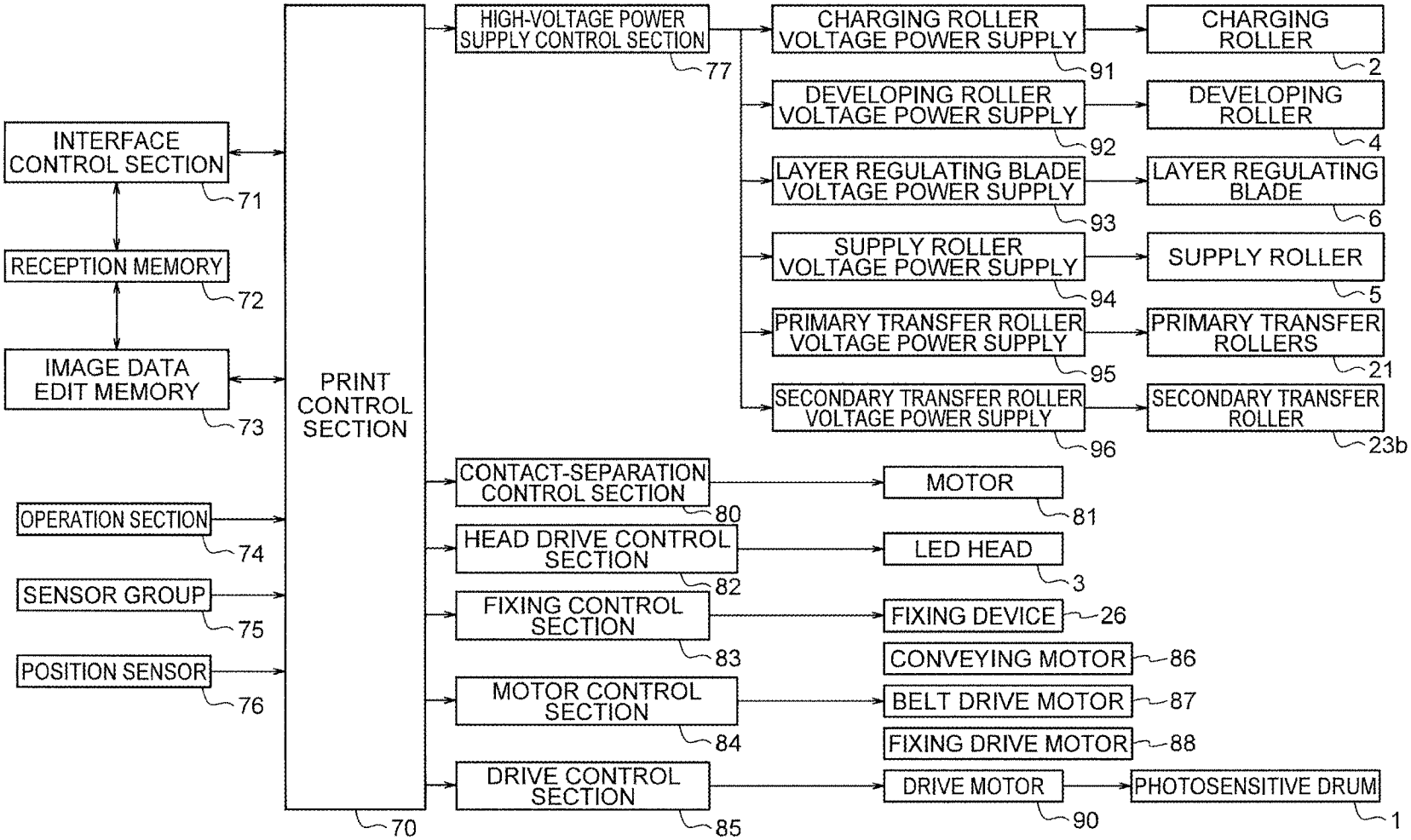
FIG. 11 is a block diagram showing a control system of the image forming apparatus in the first embodiment.

The medium supply section 40 is disposed in a lower part of the image forming apparatus 100. The medium supply section 40 includes a paper cassette 41 as a medium storage section for storing a stack of recording media P, a paper feed roller 42 that feeds the recording media P one by one from the paper cassette 41, and conveying rollers 43 that convey the recording medium P fed from the paper feed roller 42 to a secondary transfer section 23 (described later). The paper feed roller 42 and the conveying rollers 43 are rotary-driven by a medium conveying motor 86 (FIG. 11).

The process units 10Y, 10M, 10C, and 10K form images by using the yellow, magenta, cyan, and black toners and are arranged from the left to the right in a row in the figure. The process units 10Y, 10M, 10C, and 10K have the same configuration except using the different toners, and are generically referred to as process units 10 in the description.

Figure 2:
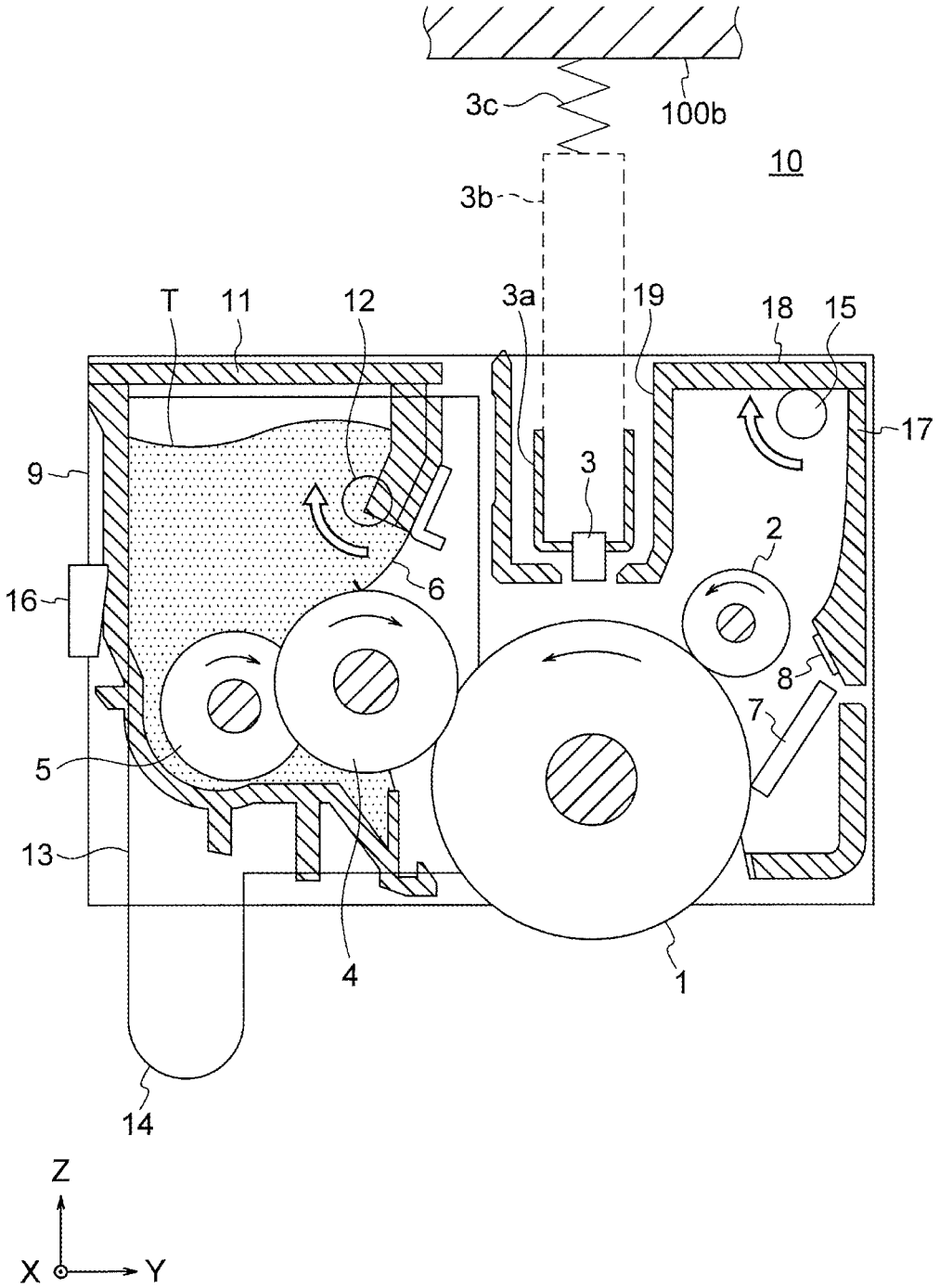
FIG. 2 is a diagram showing a process unit of the first embodiment.

FIG. 2 is a sectional view showing the process unit 10. The process unit 10 includes a photosensitive drum 1 as an image carrier (or an electrostatic latent image carrier), a charging roller 2 as a charging member, a developing roller 4 as a developer carrier, a supply roller 5 as a developer supplier, a layer regulating blade 6 as a developer layer forming member, a cleaning blade 7 as a cleaning member, and a charge elimination device 8. These components are disposed inside a housing 17 of the process unit 10. In a place higher than the photosensitive drum 1, an LED head 3 as an exposure device is disposed so as to face thereto.

The photosensitive drum 1 is a cylindrical conductive support the surface of which is laminated with photosensitive layers, for example. The conductive support is made of metal such as aluminum. The photosensitive layer is an organic photoreceptor and has a layered body of a charge generating layer and a charge transport layer. The photosensitive drum 1 is rotated counterclockwise in the figure, by a drive motor 90 (FIG. 11).

The charging roller 2 is, for example, a metal shaft with a semiconductive epichlorohydrin rubber layer formed on its surface. The charging roller 2 is disposed so as to be in contact with the surface of the photosensitive drum 1 and rotates following the photosensitive drum 1. A charging voltage is applied to the charging roller 2 by a charging roller voltage power supply 91 (FIG. 11), and the surface of the photosensitive drum 1 is charged uniformly.

The LED head 3 is disposed so as to face the photosensitive drum 1. The LED head 3 includes a plurality of light emitting diodes (LEDs) arranged in a row parallel to a rotation axis of the photosensitive drum 1 and a lens array including a plurality of lens elements which turn the light of the LEDs into an image on the surface of the photosensitive drum 1. Light emission of the LED head 3 is controlled by a head drive control section 82 (FIG. 11), the surface of the photosensitive drum 1 is exposed to the light, and a latent image (electrostatic latent image) is formed.

A holder 3*a* is the housing of the LED head 3 and is mounted through a mounting member 3*b* onto an upper cover 100*b* of the image forming apparatus 100. In the housing 17 of the process unit 10, a depressed portion 19 that contains the holder 3*a* of the LED head 3 is formed. The holder 3*a* of the LED head 3 is pressed toward the photosensitive drum 1 by a spring 3*c* and is in contact with a positioning surface, which is not shown in the figure.

The developing roller 4 is, for example, a metal shaft with a semiconductive urethane rubber layer formed on its surface. The developing roller 4 is disposed so as to be in contact with the surface of the photosensitive drum 1 and rotates clockwise in the figure by rotation transmitted from the drive motor 90 (FIG. 11). A developing voltage is applied to the developing roller 4 by a developing roller voltage power supply 92 (FIG. 11). The developing roller 4 carries the toner on its surface, develops the latent image formed on the surface of the photosensitive drum 1 with the toner, and forms a toner image (developer image).

The supply roller 5 is, for example, a metal shaft with a foamed semiconductive silicone rubber layer formed on its surface. The supply roller 5 is disposed so as to be in contact with the surface of the developing roller 4 and rotates clockwise in the figure by rotation transmitted from the drive motor 90 (FIG. 11). A supply voltage is applied to the supply roller 5 by a supply roller voltage power supply 94 (FIG. 11).

The layer regulating blade 6 is a metal blade and is pressed against the surface of the developing roller 4. A layer regulating blade voltage is applied to the layer regulating blade 6 by a layer regulating blade voltage power supply 93 (FIG. 11), and the layer regulating blade 6 forms a toner layer of uniform thickness on the surface of the developing roller 4.

Above the developing roller 4, the supply roller 5, and the layer regulating blade 6, toner storage section (developer storage section) which stores the toner T as the developer is provided.

The cleaning blade 7 is a blade made of urethane rubber and removes residual toner remaining on the surface of the photosensitive drum 1 after transfer (primary transfer) of the toner image. The charge elimination device 8 has an LED, for example, and eliminates charge remaining on the surface of the photosensitive drum 1 after the transfer of the toner image.

In the process unit 10, a part including the developing roller 4, the supply roller 5, and the layer regulating blade 6 is referred to as a developing unit 11. On the other hand, a part including the photosensitive drum 1, the charging roller 2, the cleaning blade 7, and the charge elimination device 8 is referred to as a latent image unit 18.

Referring back to FIG. 1, the transfer belt unit 25 is disposed so as to face the process units 10Y, 10M, 10C, and 10K in their lower sides. The transfer belt unit 25 includes an intermediate transfer belt 20 as a transfer body. The intermediate transfer belt 20 is a seamless belt, and its outer surface is in contact with the photosensitive drums 1 of the process units 10Y, 10M, 10C, and 10K.

The transfer belt unit 25 also includes primary transfer rollers 21Y, 21M, 21C, and 21K, a driving roller 22*a*, a driven roller 22*b*, guide rollers 22*c*, 22*d*, and 22*e*, and a secondary transfer backup roller 23*a* on the side of the inner surface of the intermediate transfer belt 20.

The primary transfer rollers 21Y, 21M, 21C, and 21K face the photosensitive drums 1 of the process units 10Y, 10M, 10C, and 10K across the intermediate transfer belt 20. The primary transfer rollers 21Y, 21M, 21C, and 21K are, for example, a metal shaft with a foamed rubber layer provided on its surface. A primary transfer voltage is applied to the primary transfer rollers 21Y, 21M, 21C, and 21K by a primary transfer roller voltage power supply 95 (FIG. 11), and the primary transfer of the toner images on the photosensitive drums 1 onto the intermediate transfer belt 20 is conducted.

The driving roller 22*a* is rotary-driven by a belt drive motor 87 (FIG. 11). Rotation of the driving roller 22*a* moves the intermediate transfer belt 20 in a direction represented by an arrow B. The driven roller 22*b* gives tension to the intermediate transfer belt 20. The guide rollers 22*c*, 22*d*, and 22*e* are disposed along the route in which the intermediate transfer belt 20 moves and guides the movement of the intermediate transfer belt 20.

A secondary transfer roller 23*b* is disposed so as to sandwich the intermediate transfer belt 20 between it and the secondary transfer backup roller 23*a* on the side of the outer surface of the intermediate transfer belt 20. To the secondary transfer roller 23*b*, a secondary transfer voltage is applied by a secondary transfer roller voltage power supply 96 (FIG. 11). The secondary transfer backup roller 23*a* and the secondary transfer roller 23*b* form a secondary transfer section 23 that transfers (secondary transfer) the toner image from the intermediate transfer belt 20 to the recording medium P.

The fixing device 26 fixes the toner image which has been transferred to the recording medium P in the secondary transfer section 23, onto the recording medium P by applying heat and pressure. The fixing device 26 includes a fixing roller 26*a* and a pressure roller 26*b*. The fixing roller 26*a* contains, inside it, a heating element such as a halogen lamp, which heats the recording medium P. The fixing roller 26*a* is rotary-driven by a fixing drive motor 88 (FIG. 11). The pressure roller 26*b* applies pressure to the recording medium P between it and the fixing roller 26*a*.

The ejection rollers 27 are disposed on the downstream side of the secondary transfer section 23 in a conveyance direction of the recording medium P. The ejection rollers 27 rotate by a rotation voltage from the fixing drive motor 88 (FIG. 11) and discharge from a discharge port 28 the recording medium P on which the toner image has been fixed by the fixing device 26. In the upper cover 100*b* of the image forming apparatus 100, a stacker section 29 in which the recording medium P discharged from the discharge port 28 is placed is provided.

In FIG. 1, let the direction of the rotation axes of the photosensitive drums 1 of the process units 10Y, 10M, 10C, and 10K be the X direction. Let the direction in which the process units 10Y, 10M, 10C, and 10K are arranged be the Y direction. Let the direction orthogonal to the X direction and the Y direction be the Z direction.

In the Y direction, let the direction in which the intermediate transfer belt 20 moves when it passes by the process units 10Y, 10M, 10C, and 10K be the +Y direction and the opposite direction be the −Y direction. The Z direction is here the vertical direction, and let the upward direction be the +Z direction and the downward direction be the −Z direction.

(Configuration of Process Unit)

Figure 3A:
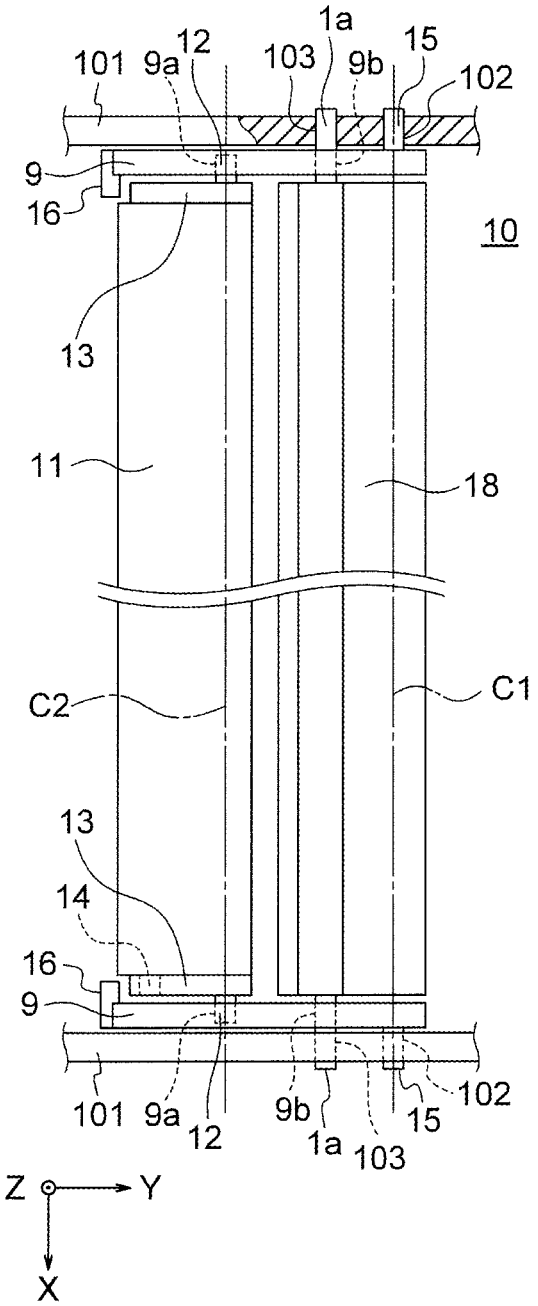
FIG. 3A is a top view showing the process unit of the first embodiment.

FIG. 3A is a top view showing the process unit 10 and shows a partial sectional view. As described above, the process unit 10 includes the developing unit 11 (including the developing roller 4, the supply roller 5, and the layer regulating blade 6) and the latent image unit 18 (including the photosensitive drum 1, the charging roller 2, the cleaning blade 7, and the charge elimination device 8). The developing unit 11 and the latent image unit 18 have a neighboring positional relationship in the Y direction.

The developing unit 11 and the latent image unit 18 are coupled to each other by a pair of coupling members 9 disposed on both sides of them in the X direction. The coupling member 9 is a plate-like member having a plate face parallel to the YZ plane, for example.

From the pair of coupling members 9, spindles 15 stick out to both sides of the X direction. With its axial direction set to the X direction, the spindle 15 is fitted into a holding hole 102 formed in a frame 101 provided in the housing 100*a* of the image forming apparatus 100. Consequently, the coupling member 9 is provided rotatably around the spindle 15.

In other words, the developing unit 11 and the latent image unit 18 (that is, the process unit 10) held by the coupling members 9 are provided rotatably around the spindles 15 (that is, the rotation axis C1 in the X direction), with respect to the frame 101 of the image forming apparatus 100.

In addition, the developing unit 11 includes a pair of side plates 13 at both ends in the X direction. From the pair of side plates 13, spindles 12 stick out to both sides of the X direction. With its axial direction set to the X direction, the spindle 12 is fitted into a holding hole 9*a* formed in the coupling member 9.

Consequently, the side plates 13 are provided rotatably around the spindles 12. In other words, the developing unit 11 is provided rotatably around the spindles 12 (that is, the rotation axis C2 in the X direction) with respect to the process unit 10.

A working section 14 (FIG. 2) is formed so as to stick out in the lower end of one side plate 13 (the side plate 13 on the +X side, here) of the pair of side plates 13. This working section 14 is a part that comes in contact with a pressing lever 32 of a contact-separation mechanism 30, which will be described later.

In addition, contact sections 16 (FIG. 2) which come into contact with end faces of the side plates 13 when the developing unit 11 rotates around the spindles 12 to a predetermined angle are formed in the pair of coupling members 9. The contact section 16 is, for example, a plate-like piece which extends from the corresponding coupling member 9 to the inside in the X direction.

Figure 3B:
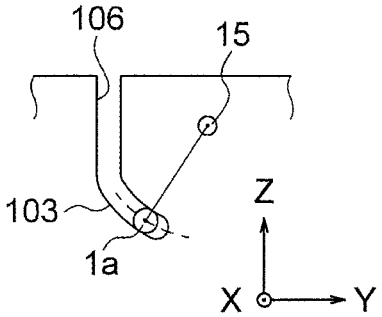
FIGS. 3B and 3C are schematic diagrams showing a part of a frame of the process unit.

Moreover, a shaft 1*a* (rotation axis) of the photosensitive drum 1 of the latent image unit 18 penetrates in the X direction through holes 9*b* formed in the coupling members 9 and groove sections 103 formed in the frame 101. Since the process unit 10 swings around the spindle 15, the groove section 103 of the frame 101 extends in the form of an arc around the spindle 15, as shown in FIG. 3B.

While the process unit 10 is in a reference state, the shaft 1*a* of the photosensitive drum 1 is held in a lower end part of the groove section 103. It is sufficient that the groove section 103 is formed just by an angle corresponding to a rotation angle of the process unit 10 around the spindle 15. From the upper end part of the groove section 103 to the upper end of the frame 101, a linear groove section 106 is formed.

Figure 3C:
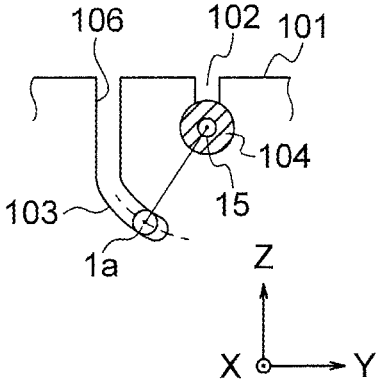

The spindle 15 of the process unit 10 is held in the holding hole 102 of the frame 101, as described above. In a preferred example of configuration, it is sufficient that the inner diameter of the holding hole 102 is larger than the outer diameter of the spindle 15 and the spindle 15 is fitted to the inner circumferential surface of a bottomed cylindrical cap 104 provided in the holding hole 102, as shown in FIG. 3C. In that case, if the configuration allows the cap 104 to be displaced in the X direction in conjunction with the opening and closing of the upper cover 100*b*, the process unit 10 could be easily mounted to the frame 101.

Figure 4:
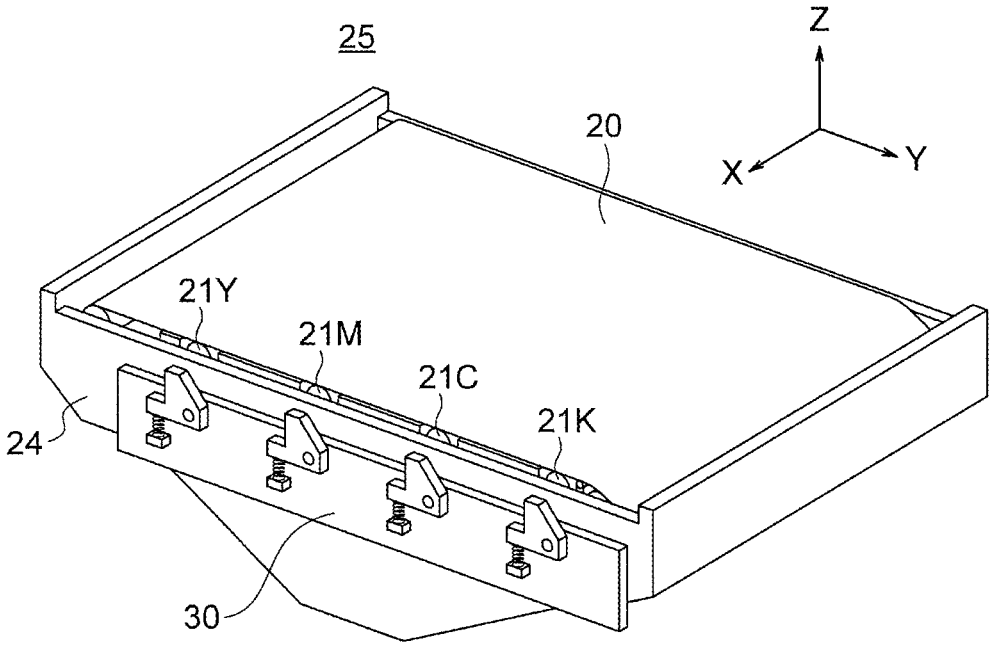
FIG. 4 is a perspective view showing the positional relationship between a transfer unit and a contact-separation mechanism of the image forming apparatus of the first embodiment.
Figure 5:
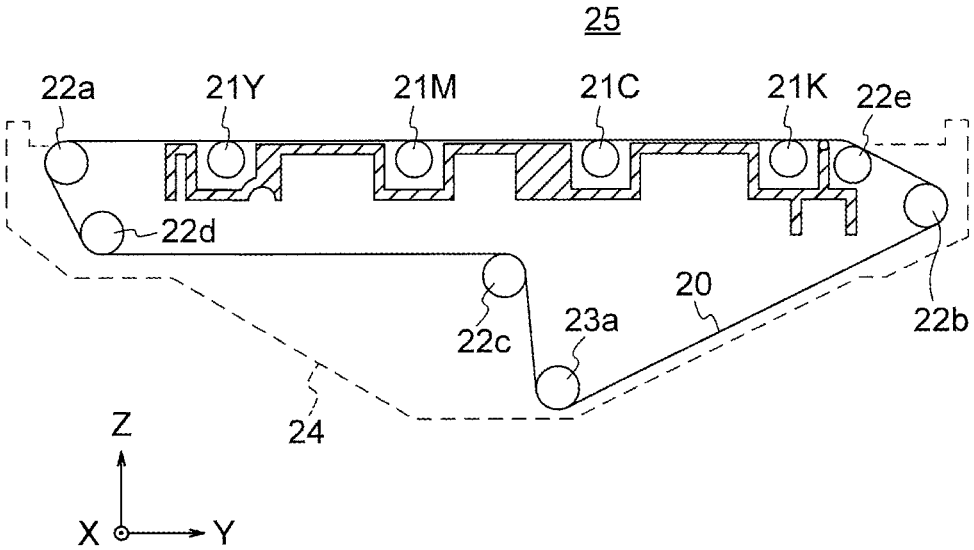
FIG. 5 is a sectional view showing a configuration example of the transfer unit of the first embodiment.

FIG. 4 is a perspective view showing the external appearance of the transfer belt unit 25, and FIG. 5 is a sectional view showing the inside of the transfer belt unit 25. The transfer belt unit includes a belt unit housing 24. In the belt unit housing 24, the intermediate transfer belt 20, the primary transfer rollers 21Y, 21M, 21C, and 21K, the driving roller 22*a*, the driven roller 22*b*, the guide rollers 22*c* to 22*e*, and the secondary transfer backup roller 23*a* are held, as shown in FIG. 5. The side of the belt unit housing 24 facing the upper part (+Z direction) of the intermediate transfer belt 20, that is, the photosensitive drum 1 is open.

As shown in FIG. 4, the contact-separation mechanism 30 for rotating the developing unit 11 and the process unit 10 (FIG. 3A) described above is disposed on one X-direction side (+X side here) of the transfer belt unit 25.

(Contact-Separation Mechanism)

Figure 6:
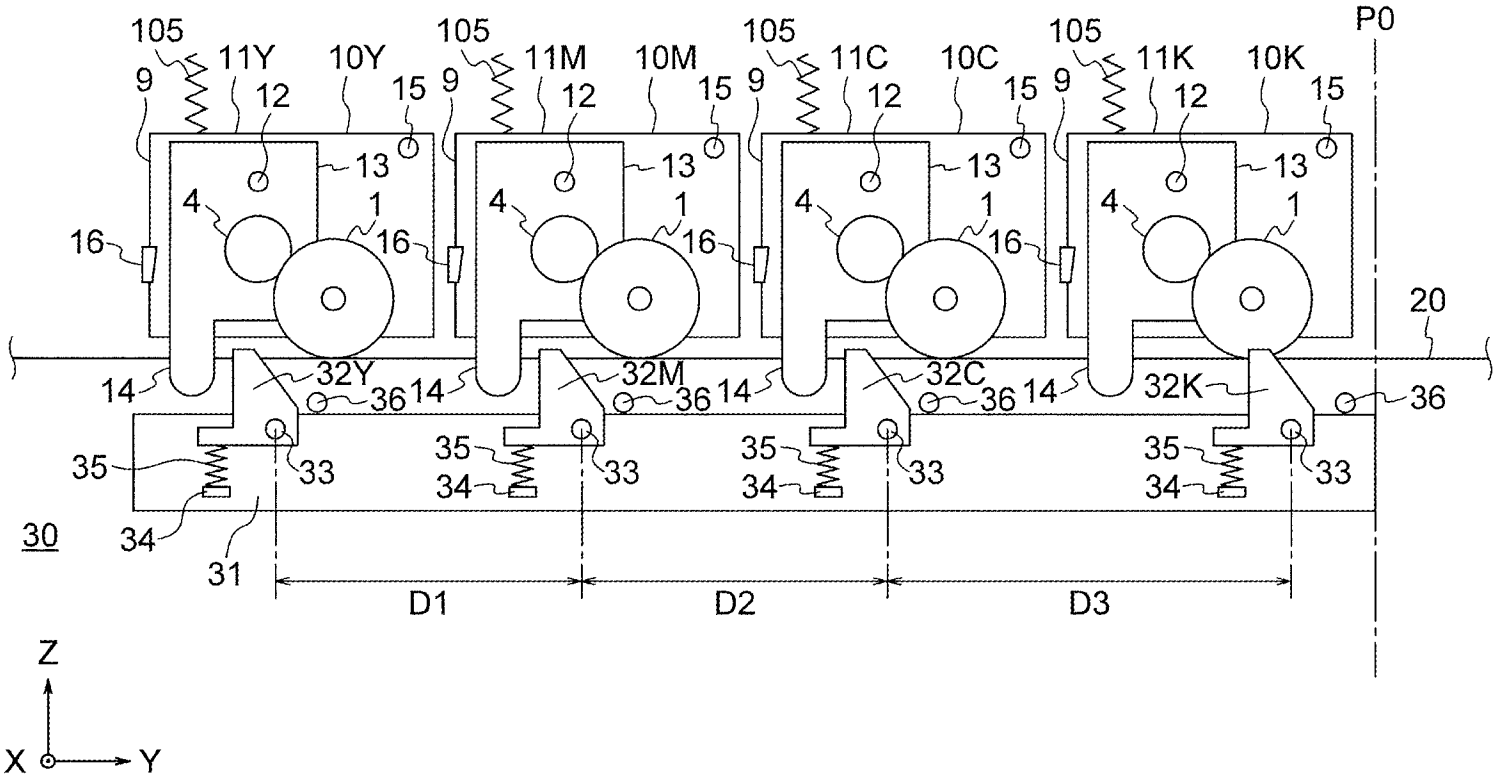
FIG. 6 is a schematic diagram showing the process units and the contact-separation mechanism in the first embodiment.

FIG. 6 is a schematic diagram showing the process units 10Y, 10M, 10C, and 10K and the contact-separation mechanism 30. FIG. 6 shows also a part of the intermediate transfer belt 20. The side plate 13 of the developing unit 11 is disposed in front (the +X side) of the photosensitive drum 1, but it is represented by a solid line for the convenience of drawing.

The developing units 11 of the process units 10Y, 10M, 10C, and 10K are respectively referred to as developing units 11Y, 11M, 11C, and 11K. As described earlier, the working section 14 sticks out downward (in the −Z direction) from the side plate 13 of the developing units 11Y, 11M, 11C, and 11K. Here, the working section 14 reaches a position lower than the contact position between the photosensitive drum 1 and the intermediate transfer belt 20. Incidentally, the developing units 11Y, 11M, 11C (first developing unit) include the yellow, magenta, cyan toners. The developing unit 11K (second developing unit) may include the black toner or a special toner such as a transparent toner.

The contact-separation mechanism 30 includes a link member 31 that is movable in the Y direction along the process units 10Y, 10M, 10C, and 10K and pressing levers 32Y, 32M, 32C, and 32K that are pressing sections mounted on the link member 31.

Figure 7:
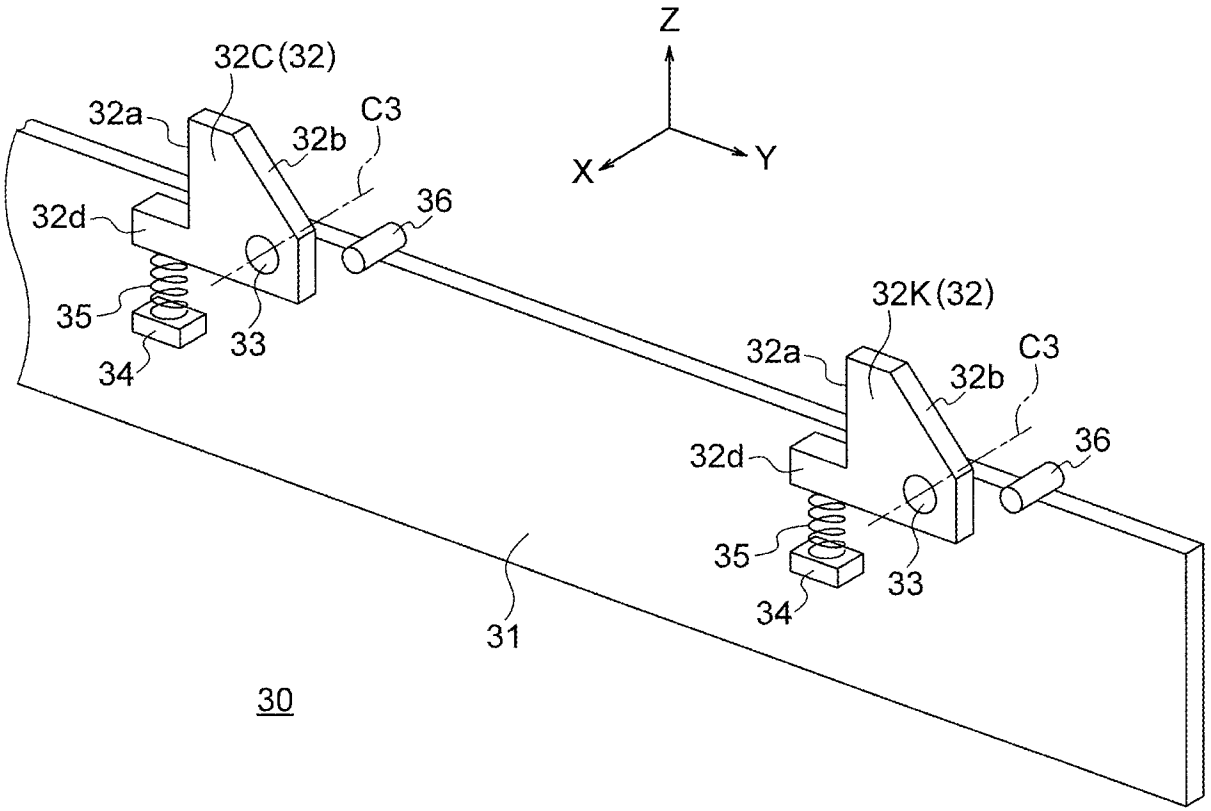
FIG. 7 is a perspective view showing the contact-separation mechanism in the first embodiment.

The link member 31 is a plate-like member having adequate stiffness and has a length in the Y direction, has a width in the Z direction, and has a thickness in the X direction (see FIG. 7). The link member 31 extends in the Y direction, covering the range of the developing unit 11Y to the developing unit 11K. The link member 31 is supported by a guide and the like provided in the housing 100*a* of the image forming apparatus 100 so that it is movable in the Y direction.

The pressing levers 32Y, 32M, 32C, and 32K are parts that press the working sections 14 of the developing units 11Y, 11M, 11C, and 11K. The pressing levers 32Y, 32M, 32C, and 32K are generically referred to as pressing levers 32 in some cases.

FIG. 7 is a magnified perspective view showing mounting structures of the two pressing levers 32C and 32K out of the pressing levers 32Y, 32M, 32C, and 32K. The pressing lever 32 is rotatably mounted on a spindle 33 in the X direction provided on the link member 31. In other words, the pressing lever 32 is provided rotatably around the spindle 33 (that is, the rotation axis C3 in the X direction).

The pressing lever 32 is, for example, a plate-like member having a plate face parallel to the YZ plane and having a thickness in the X direction. The spindle 33 is disposed on the +Y side of the Y-direction center of the pressing lever 32. The pressing lever 32 has an abutment surface 32*a* on its −Y side that comes into contact with the working section 14 of the developing unit 11 and has a locking surface 32*b* on its +Y side that comes into contact with a rotation regulation section 36 (described later).

Disposed adjacent to the +Y side of the pressing lever 32 is a rotation regulation section 36 that comes into contact with the locking surface 32*b* of the pressing lever 32 and regulates the range of rotation of the pressing lever 32. The rotation regulation section 36 is, for example, a pin-like member fixed to the upper end of the link member 31.

The pressing lever 32 includes a protrusion part 32*d* that protrudes more in the −Y direction than the abutment surface 32*a*. In a position lower than (−Z direction) the protrusion part 32*d*, a spring 35 is disposed as a pressing member (pressing part). The spring 35 is supported from below by a spring support part 34 provided on the link member 31. That is, one end of the spring 35 is in contact with the protrusion part 32*d* of the pressing lever 32, and the other end is in contact with the spring support part 34.

When the abutment surface 32*a* of the pressing lever 32 comes into contact with the working section 14, the pressing lever 32 is rotated clockwise around the spindle 33 by the reaction force from the working section 14 (see FIG. 9A) and the length of the spring 35 is increased, and the spring 35 presses the pressing lever 32 to rotate counterclockwise. If the pressing lever 32 rotates clockwise further, the locking surface 32*b* of the pressing lever 32 comes into contact with the rotation regulation section 36.

Referring back to FIG. 6, the three pressing levers 32Y, 32M, and 32C out of the pressing levers 32Y, 32M, 32C, and 32K of the contact-separation mechanism 30 are placed at regular intervals. That is, spacing D1 between the pressing levers 32Y and 32M is equal to spacing D2 between the pressing levers 32M and 32C (D1=D2). On the other hand, spacing D3 between the pressing levers 32C and 32K is wider than D1 (=D2).

The link member 31 slides in the Y direction by a driving force of a motor 81 (FIG. 11) as a driving source. The motor 81 can be a servomotor or can be a different type of motor. The position of the link member 31 in the Y direction is detected by a position sensor 76 (FIG. 11), for example. If the motor 81 is the servomotor, the position of the link member 31 in the Y direction can be detected by the control signal of the servomotor, and thus the need for providing the position sensor 76 can be eliminated.

The process units 10Y, 10M, 10C, and 10K are pressed counterclockwise around the spindle 15, for example, by a spring 105. This causes the process units 10Y, 10M, 10C, and 10K to be held in a stable condition in the reference state (described later) in which the shaft 1*a* of the photosensitive drum 1 is in contact with the lower end of the groove section 103 (FIG. 3B). This spring 105 is omitted in the other drawings.

Between the developing unit 11 and the latent image unit 18 (FIG. 2), a pressing member (such as a spring) which presses counterclockwise the developing unit 11 counterclockwise around the spindle 12 in FIG. 6 is provided. In the reference state, by the pressing force of the pressing member, the developing roller 4 is in contact with the photosensitive drum 1 at a predetermined contact pressure.

Figures 8A, 8B:
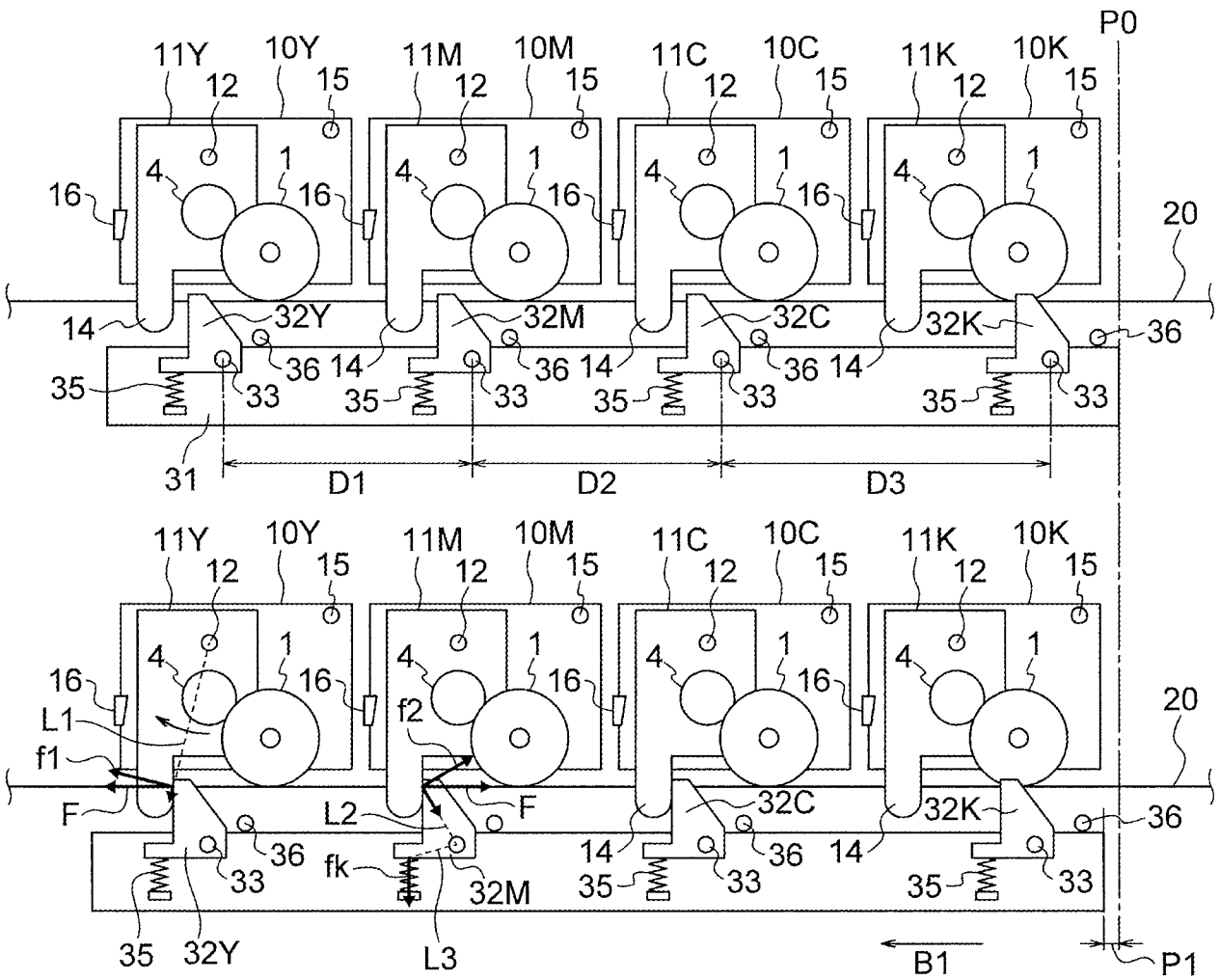
FIGS. 8A and 8B are diagrams illustrating the operation of the contact-separation mechanism in the first embodiment.

The operation of the contact-separation mechanism 30 will next be described. FIG. 8A is a schematic diagram showing the process units 10Y, 10M, 10C, and 10K and the contact-separation mechanism 30 in a case where color printing is performed. As shown in FIG. 8A, in the case where the color printing is performed, in all the process units 10Y, 10M, 10C, and 10K, the developing roller 4 is in contact with the photosensitive drum 1, and the photosensitive drum 1 is in contact with the intermediate transfer belt 20. This state is referred to as the reference state of the process units 10Y, 10M, 10C, and 10K.

In this state, the link member 31 of the contact-separation mechanism 30 is placed in an end in the +Y direction of a movement range. This position of the link member 31 is referred to as a reference position P0. When the link member 31 is in the reference position P0 as described above, the pressing levers 32Y, 32M, 32C, and 32K are not in contact with the working sections 14 of the developing units 11Y, 11M, 11C, and 11K.

FIG. 8B is a schematic diagram which shows the process units 10Y, 10M, 10C, and 10K and the contact-separation mechanism 30 when the link member 31 moves by a distance P1 from the reference position P0 in the −Y direction indicated by B1 in FIG. 8B. The position of the link member 31 shown in FIG. 8B is also referred to as a position P1 for convenience.

If the link member 31 moves by the distance P1 from the reference position P0 in the −Y direction, the pressing levers 32Y, 32M, and 32C come into contact with the working sections 14 of the developing units 11Y, 11M, and 11C respectively and press them in the −Y direction.

Letting the distance from the spindle 12, which is the rotation axis of the developing unit 11, to the contact position between the working section 14 and the pressing lever 32 be L1, force in the −Y direction given from the pressing lever 32 to the working section 14 be F, and a component of the force F in the rotation direction around the spindle 12 be f1, a rotational moment acting on the developing unit 11 is f1×L1.

The pressing lever 32 receives force F in the +Y direction as the reaction force from the working section 14. Since the pressing lever 32 is provided rotatably around the spindle 33, a rotational moment f2×L2 acts on the pressing lever 32, where L2 is the distance from the spindle 33 to the contact position between the pressing lever 32 and the working section 14 and f2 is a component of the force F in the rotation direction around the spindle 33.

Pressing force fk by the spring 35 also acts on the pressing lever 32. The pressing force fk and distances L2 and L3 are set to meet fk×L3>f2×L2, where L3 is the distance from the spindle 33 to the spring 35.

That is, in the state shown in FIG. 8B, the pressing levers 32Y, 32M, 32C, and 32K are in contact with the working sections 14 of the developing units 11Y, 11M, and 11C, but because of the pressing force fk of the spring 35, the developing units 11Y, 11M, and 11C do not rotate. In addition, the pressing lever 32K is not in contact with the working section 14 of the developing unit 11K, and thus the developing unit 11K does not rotate.

Therefore, in the state shown in FIG. 8B, the developing roller 4 is in contact with the photosensitive drum 1, and the photosensitive drum 1 is in contact with the intermediate transfer belt 20, in all the process units 10Y, 10M, 10C, and 10K.

Figure 9A:
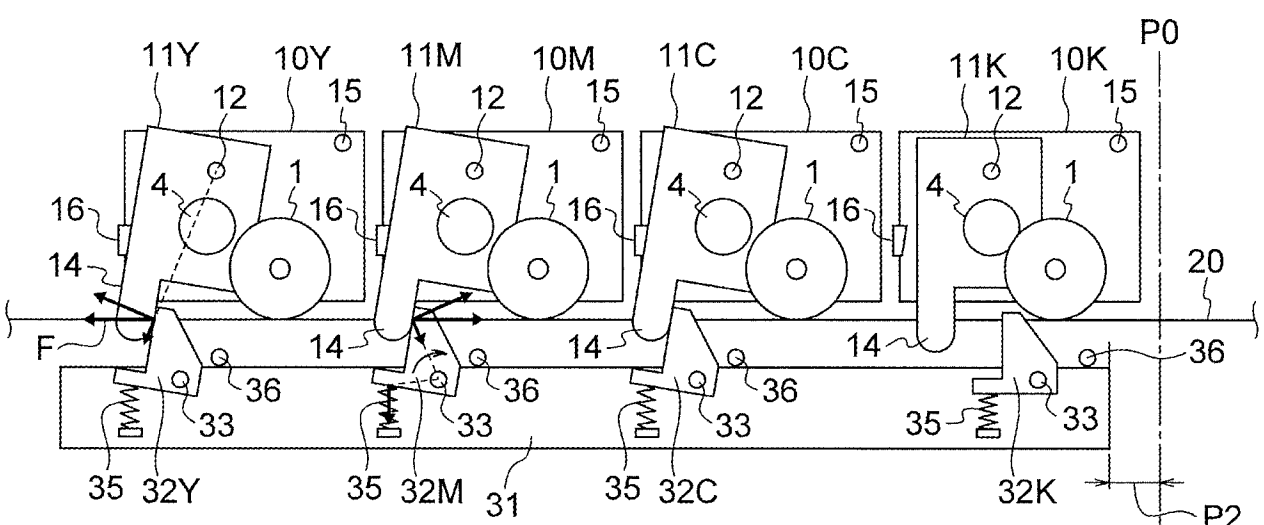
FIGS. 9A and 9B are diagrams illustrating the operation of the contact-separation mechanism in the first embodiment.

FIG. 9A is a schematic diagram which shows the process units 10Y, 10M, 10C, and 10K and the contact-separation mechanism 30 when the link member 31 moves by a distance P2 (>P1) from the reference position P0 in the −Y direction. The position of the link member 31 shown in FIG. 9A is also referred to as a position P2 for convenience.

When the link member 31 moves by the distance P2 from the reference position P0 in the −Y direction, the pressing levers 32Y, 32M, and 32C press the working sections 14 of the developing units 11Y, 11M, and 11C, and the developing units 11Y, 11M, and 11C rotate clockwise around the spindle 12. The developing units 11Y, 11M, and 11C rotate and thereby the developing roller 4 is separated from the photosensitive drum 1. On the other hand, the pressing lever 32K is not in contact with the working section 14 of the developing unit 11K, and thus the developing unit 11K does not rotate.

When the rotation angle of the developing units 11Y, 11M, and 11C reaches the predetermined angle, the end faces of the side plates 13 of the developing units 11Y, 11M, and 11C come into contact with the contact sections 16 of the process units 10Y, 10M, and 10C respectively, and the developing units 11Y, 11M, and 11C temporarily stop rotating.

Since the force (force in the +Y direction) given from the working section 14 of the developing units 11Y, 11M, and 11C to the pressing lever 32 increases, the pressing levers 32Y, 32M, and 32C rotate clockwise around the spindle 33 against the pressing force of the spring 35.

In this state, the developing roller 4 is separated from the photosensitive drum 1, but the photosensitive drum 1 is still in contact with the intermediate transfer belt 20, in the process units 10Y, 10M, and 10C. In addition, in the process unit 10K, the developing roller 4 is in contact with the photosensitive drum 1, and the photosensitive drum 1 is in contact with the intermediate transfer belt 20.

Figure 9B:
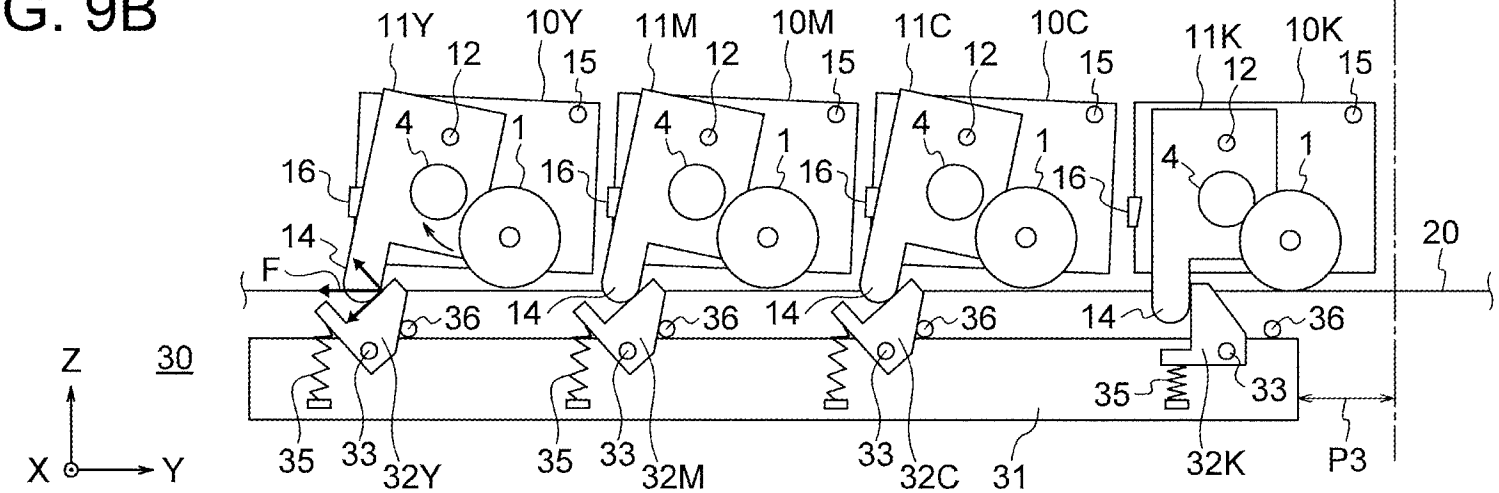

FIG. 9B is a schematic diagram which shows the process units 10Y, 10M, 10C, and 10K and the contact-separation mechanism 30 when the link member 31 moves by a distance P3 (>P2) from the reference position P0 in the −Y direction. The position of the link member 31 shown in FIG. 9B is also referred to as a position P3 for convenience.

When the link member 31 moves by the distance P3 in the −Y direction, the pressing levers 32Y, 32M, and 32C rotate clockwise and come into contact with the rotation regulation section 36. In this state, a straight line connecting the contact part between the pressing lever 32 and the working section 14 and the spindle 15 of the process unit 10 makes an angle of 45 degrees with respect to the Y direction.

The pressing levers 32Y, 32M, and 32C press the working sections 14 of the developing units 11Y, 11M, and 11C, and thereby the developing units 11Y, 11M, and 11C rotate clockwise around the spindle 12. In conjunction with this rotation, the process units 10Y, 10M, and 10C rotate clockwise around the spindle 15.

Therefore, in the process units 10Y, 10M, and 10C, the developing roller 4 is separated from the photosensitive drum 1, and the photosensitive drum 1 is also separated from the intermediate transfer belt 20. A preferred distance of separation between the developing roller 4 and the photosensitive drum 1 is 1 to 2 mm, for example. A preferred distance of separation between the photosensitive drum 1 and the intermediate transfer belt 20 is 1 to 1.5 mm, for example.

On the other hand, the pressing lever 32K is not in contact with the working section 14 of the developing unit 11K. Consequently, in the process unit 10K, the developing roller 4 is in contact with the photosensitive drum 1, and the photosensitive drum 1 is in contact with the intermediate transfer belt 20.

Therefore, in the state shown in FIG. 9B, monochrome printing, in which black images are printed by the process unit 10K, can be performed. As described earlier, in the process units 10Y, 10M, and 10C, which are not used in the monochrome printing, the developing roller 4 is separated from the photosensitive drum 1, the photosensitive drum 1 is separated from the intermediate transfer belt 20, and thus the wearing out of the photosensitive drum 1 can be prevented.

As has been described with reference to FIG. 2, the LED head 3 is mounted on the upper cover 100*b* of the image forming apparatus 100, and the spring 3*c* provided between them makes room for displacement in the Y direction, enabling a movement following the rotation of the process units 10Y, 10M, and 10C while the holder 3*a* of the LED head 3 is contained in the depressed portion 19. Moreover, a clearance is provided between the holder 3*a* of the LED head 3 and the depressed portion 19. Therefore, when the process unit 10Y, 10M, or 10C rotates, the LED head 3 does not come into contact with the peripheral members.

Figure 10:
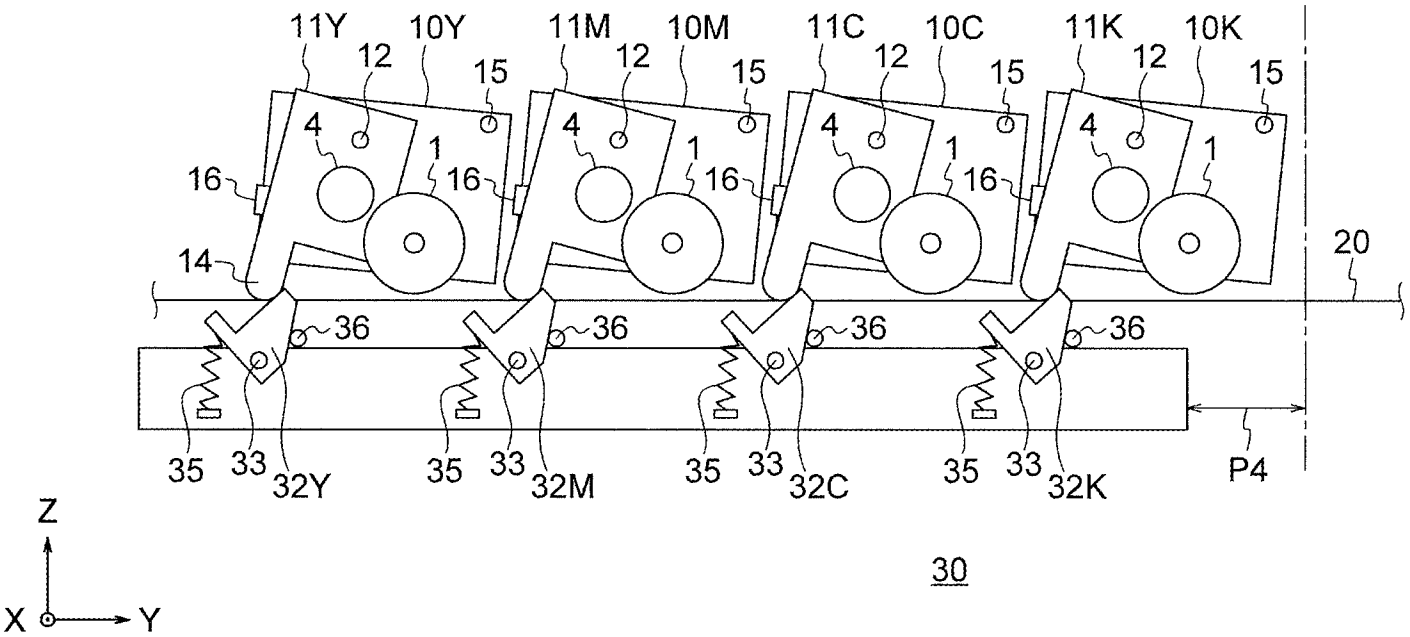
FIG. 10 is a diagram showing the operation of the contact-separation mechanism in the first embodiment.

FIG. 10 is a schematic diagram which shows the process units 10Y, 10M, 10C, and 10K and the contact-separation mechanism 30 when the link member 31 moves by a distance P4 (>P3) from the reference position P0 in the −Y direction. The position of the link member 31 shown in FIG. 10 is also referred to as a position P4 for convenience.

When the link member 31 moves by the distance P4 in the −Y direction, the pressing lever 32K presses the working section 14 of the developing unit 11K, and the developing unit 11K rotates clockwise around the spindle 12. In addition, the side plate 13 of the developing unit 11K comes into contact with the contact section 16, and both the developing unit 11K and the process unit 10K rotate clockwise. The pressing lever 32K comes into contact with the rotation regulation section 36, and thereby the rotation of the pressing lever 32K is regulated.

Accordingly, in all the process units 10Y, 10M, 10C, and 10K, the developing roller 4 is separated from the photosensitive drum 1, and the photosensitive drum 1 is separated from the intermediate transfer belt 20. In this state, the image forming apparatus 100 stops printing and can enter a sleep mode, for example.

As described above, in all the process units 10Y, 10M, 10C, and 10K, the developing roller 4 is separated from the photosensitive drum 1, and the photosensitive drum 1 is separated from the intermediate transfer belt 20, and therefore even if the image forming apparatus 100 is left unused for a long period of time, the surface of the developing roller 4 is kept free of indentation, which could be developed through a long period of contact with the photosensitive drum 1. The deterioration of toner resulting from the transfer of toner from the developing roller 4 to the photosensitive drum 1 can also be suppressed.

Since the pressing levers 32Y, 32M, 32C, and 32K have not yet rotated in the state shown in FIG. 8B as described earlier, the travel distance of the link member 31 from the reference position P0 to the position P4 can be reduced relatively. Consequently, the whole length of the contact-separation mechanism 30 in the Y direction can be reduced.

(Control System)

FIG. 11 is a block diagram illustrating the control system of the image forming apparatus 100. The image forming apparatus 100 includes a print control section 70, an interface control section 71, a reception memory 72, an image data edit memory 73, an operation section 74, a sensor group 75 and the position sensor 76, a high-voltage power supply control section 77, a contact-separation control section 80, the head drive control section 82, a fixing control section 83, a motor control section 84, and a drive control section 85.

The print control section 70 includes, for example, a microprocessor, a ROM, a RAM, an input output port, a timer, and so on. The print control section 70 receives print data and control commands through the interface control section 71 and performs print operation by controlling the entire operation of the image forming apparatus 100. The print control section 70 sends control signals to the image data edit memory 73, the high-voltage power supply control section 77, the contact-separation control section 80, the head drive control section 82, the fixing control section 83, the motor control section 84, and the drive control section 85.

The interface control section 71 receives the print data and control commands from a high-level device (such as an external computer). The reception memory 72 is a memory which temporarily stores the print data received by the interface control section 71. The image data edit memory 73 generates image data by performing edit processing of the print data stored in the reception memory 72 and stores the image data.

The operation section 74 includes a display section (such as an LED) for displaying the state of the image forming apparatus 100 and an operation input section (such as a switch and a display panel) that accepts the input of the operator. The sensor group 75 includes various sensors that monitor the status of the image forming apparatus 100, such as a medium position sensor that detects the position of the recording medium P, a temperature and humidity sensor that detects the ambient temperature and humidity, a print density sensor that detects the print density, and a residual toner sensor that detects the residual amount of toner in the toner storage section.

The high-voltage power supply control section 77 controls the charging roller voltage power supply 91 that applies the charging voltage to the charging roller 2, the developing roller voltage power supply 92 that applies the developing voltage to the developing roller 4, the layer regulating blade voltage power supply 93 that applies the layer regulating blade voltage to the layer regulating blade 6, the supply roller voltage power supply 94 that applies the supply voltage to the supply roller 5, the primary transfer roller voltage power supply 95 that applies the primary transfer voltage to the primary transfer rollers 21, and the secondary transfer roller voltage power supply 96 that applies the secondary transfer voltage to the secondary transfer roller 23*b*.

The contact-separation control section 80 drives the motor 81 for moving the link member 31 in the Y direction in accordance with the control signal from the print control section 70. The head drive control section 82 controls the light emission of the LED head 3 in accordance with the image data output from the image data edit memory 73 to the print control section 70.

The fixing control section 83 controls current to be supplied to the heating element (such as the halogen lamp) of the fixing roller 26*a* of the fixing device 26, in accordance with the control signal from the print control section 70 and the temperature detected by the temperature sensor (such as a thermistor) provided in the fixing device 26.

The motor control section 84 controls the medium conveying motor 86, the belt drive motor 87, and the fixing drive motor 88 in accordance with the control signals from the print control section 70. The drive control section 85 controls the drive motor 90 in accordance with the control signal from the print control section 70.

(Print Operation)

Figure 12:
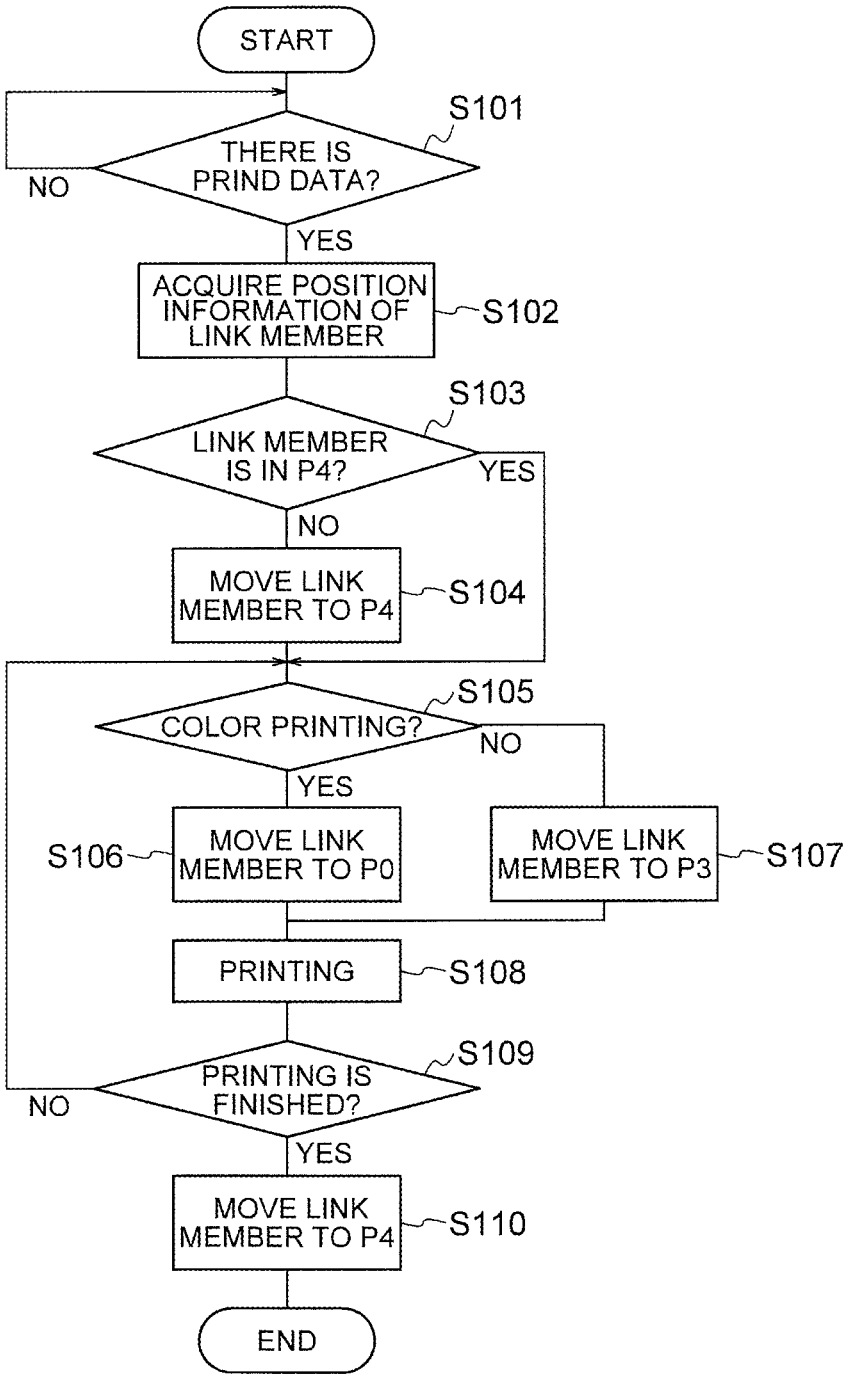
FIG. 12 is a flowchart illustrating the operation of the image forming apparatus of the first embodiment.

FIG. 12 is a flowchart illustrating printing (image forming operation) by the image forming apparatus 100. When the operator turns on the image forming apparatus 100, the print control section 70 judges whether there are print data and a print command sent from a high-level device (step S101).

If the print data and the print command are received, the print control section 70 acquires the position information of the link member 31 in accordance with the position sensor 76 (step S102). It is judged whether the link member 31 is in the position P4 (FIG. 10) (step S103), and if the link member 31 is not in the position P4, the motor 81 is driven to move the link member 31 to the position P4 (step S104).

Then, the print control section 70 judges in accordance with the print command received in step S101 whether it is the color printing (step S105). If it is the color printing, the print control section 70 drives the motor 81 to move the link member 31 to the reference position P0 (step S106).

When the link member 31 is moved to the reference position P0, the developing roller 4 comes into contact with the photosensitive drum 1, and the photosensitive drum 1 comes into contact with the intermediate transfer belt 20, as shown in FIG. 8A, in all the process units 10Y, 10M, 10C, and 10K, and consequently the color printing becomes possible.

On the other hand, if it is not the color printing (that is, if it is the monochrome printing), the print control section 70 dives the motor 81 to move the link member 31 to the position P3 (step S107). When the link member 31 is moved to the position P3, the developing roller 4 is separated from the photosensitive drum 1, and the photosensitive drum 1 is separated from the intermediate transfer belt 20, as shown in FIG. 9B, in the process units 10Y, 10M, and 10C. In the process unit 10K, the developing roller 4 comes into contact with the photosensitive drum 1, and the photosensitive drum 1 comes into contact with the intermediate transfer belt 20. Consequently, the monochrome printing becomes possible.

After the link member 31 is moved to the reference position P0 (FIG. 8A) or the position P3 (FIG. 9B) as described above, the color printing or the monochrome printing is performed (step S108).

The color printing is performed as described below. That is, in the process units 10Y, 10M, 10C, and 10K, the drive motor 90 rotates the photosensitive drum 1. From the charging roller voltage power supply 91, the developing roller voltage power supply 92, the supply roller voltage power supply 94, and the layer regulating blade voltage power supply 93, the charging voltage, the developing voltage, the supply voltage, and the layer regulating blade voltage are applied respectively to the charging roller 2, the developing roller 4, the supply roller 5, and the layer regulating blade 6.

When the photosensitive drum 1 rotates, the rotation of the photosensitive drum 1 is transmitted and thereby the developing roller 4 and the supply roller 5 rotates. Following the rotation of the photosensitive drum 1, the charging roller 2 rotates. Moreover, the belt drive motor 87 rotates the driving roller 22*a* and moves the intermediate transfer belt 20. The fixing drive motor 88 rotates the fixing roller 26*a* and the ejection rollers 27.

The charging roller 2 charges the surface of the photosensitive drum 1 uniformly. The LED head 3 exposes the uniformly charged surface of the photosensitive drum 1 to the light in accordance with the image data of each color, and forms the electrostatic latent image. The surface of the developing roller 4 is given the toner from the supply roller 5, and the toner layer is formed by the layer regulating blade 6. The developing roller 4 applies the toner to the electrostatic latent image on the surface of the photosensitive drum 1, to form the toner image.

To the primary transfer rollers 21Y, 21M, 21C, and 21K, the primary transfer voltage is applied by the primary transfer roller voltage power supply 95, and the toner image on each photosensitive drum 1 is primary-transferred to the intermediate transfer belt 20. Consequently, the yellow, magenta, cyan, and black toner images formed by the process units 10Y, 10M, 10C, and 10K are sequentially transferred on the intermediate transfer belt 20.

The medium conveying motor 86 rotates the paper feed roller 42, which supplies the recording medium P from the paper cassette 41 to the conveyance path. Just at the timing when the toner image on the intermediate transfer belt 20 reaches the secondary transfer section 23, the conveying rollers 43 convey the recording medium P to the secondary transfer section 23.

To the secondary transfer roller 23*b* of the secondary transfer section 23, the secondary transfer voltage is applied by the secondary transfer roller voltage power supply 96. Consequently, the toner image on the intermediate transfer belt 20 is transferred (secondary-transferred) to the recording medium P passing between the secondary transfer backup roller 23*a* and the secondary transfer roller 23*b*. The recording medium P which has passed the secondary transfer section 23 is conveyed to the fixing device 26.

In the fixing device 26, the fixing roller 26*a* is heated to a predetermined fixing temperature beforehand. The fixing roller 26*a* and the pressure roller 26*b* apply heat and pressure to the recording medium P to fix the toner image onto the recording medium P. The ejection rollers 27 discharge from the discharge port 28 the recording medium P which has passed the fixing device 26. The discharged recording medium P is placed in the stacker section 29.

The monochrome printing differs from the color printing in that only the process unit 10K out of the process units 10Y, 10M, 10C, and 10K is used to form images. In other respects, the monochrome printing is the same as the color printing.

After the color printing or the monochrome printing is performed as described above, the print control section 70 judges whether to continue the printing (whether the print data remain, for example) (step S109). If the printing is continued, the processing goes back to step S105 to judge whether it is the color printing, and the link member 31 is moved to the reference position P0 or the position P3 to perform printing. If the printing is not continued, the link member 31 is moved to the position P4 (FIG. 10), which is the retracting position (step S110), and the print operation is ended.

(Effects of First Embodiment)

As has been described above, in the first embodiment of the present invention, the contact-separation mechanism 30 that brings the developing roller 4 and the photosensitive drum 1 into contact with each other and separates them from each other and brings the photosensitive drum 1 and the intermediate transfer belt 20 into contact with each other and separate them from each other is provided. This allows the developing roller 4 to be separated from the photosensitive drum and the photosensitive drum 1 to be separated from the intermediate transfer belt 20, in the process unit not to be used.

Accordingly, in a case where the image forming apparatus 100 is not in use, the developing roller 4 can be kept separated from the photosensitive drum 1, the surface of the developing roller 4 can be kept free of indentation, and the deterioration of toner resulting from the transfer of toner from the developing roller 4 to the photosensitive drum 1 can be suppressed. Moreover, in the monochrome printing, the photosensitive drums 1 of the process units 10Y, 10M, and 10C is separated from the intermediate transfer belt 20, and thereby the wearing out of the photosensitive drums 1 can be suppressed.

Since a movement of the common link member 31 can bring the developing rollers 4 and the photosensitive drums 1 into contact with each other and separate them from each other and bring the photosensitive drums 1 and the intermediate transfer belt 20 into contact with each other and separate them from each other in the process units 10Y, 10M, 10C, and 10K, the configuration of the contact-separation mechanism 30 is simplified. Furthermore, since the contact-separation mechanism 30 requires just a single driving source, it can also be easily controlled.

Since a rotation of the developing unit 11 brings the developing roller 4 into contact with the photosensitive drum 1 or separates them from each other and since a rotation of the process unit 10 brings the photosensitive drum 1 into contact with the intermediate transfer belt 20 or separates them from each other, the contact and separation between the developing roller 4 and the photosensitive drum 1 and the contact and separation between the photosensitive drum 1 and the intermediate transfer belt 20 can be implemented by a simple configuration.

From a state in which the developing roller 4 is in contact with the photosensitive drum 1, the developing unit 11 rotates by the predetermined angle in a predetermined direction (such as clockwise) and thereby the developing roller 4 is separated from the photosensitive drum 1; after the developing unit 11 reaches the given angle, the process unit 10 rotates in the predetermined direction in conjunction with the developing unit 11 and thereby the photosensitive drum 1 is separated from the intermediate transfer belt 20. Accordingly, first the developing roller 4 can be separated from the photosensitive drum 1, and then the photosensitive drum 1 can be separated from the intermediate transfer belt 20.

According to the position of the link member 31, the state (FIG. 9B) in which the pressing levers 32Y, 32M, and 32C (first pressing section) are pressing the developing units 11Y, 11M, and 11C (first developing unit) while the pressing lever 32K (second pressing section) is not pressing the developing unit 11K (second developing unit), the state (FIG. 8A) in which the pressing levers 32Y, 32M, and 32C are not pressing the developing units 11Y, 11M, and 11C while the pressing lever 32K is not pressing the developing unit 11K, and the state (FIG. 10) in which the pressing levers 32Y, 32M, and 32C are pressing the developing units 11Y, 11M, and 11C while the pressing lever 32K is pressing the developing unit 11K can be taken. Accordingly, by moving the link member 31, the contact separation state between the developing roller 4 and the photosensitive drum 1 and the contact separation state between the photosensitive drum 1 and the intermediate transfer belt 20 can be switched, according to whether the color printing or the monochrome printing is performed or whether the printing is stopped.

By making the spacing D3, at which the pressing lever 32K is placed, wider than the spacing D1 (=D2), at which the pressing levers 32Y, 32M, and 32C are placed, the states described above can be switched easily.

Since the pressing levers 32Y, 32M, 32C, and 32K are rotatably mounted on the link member 31 and are pressed by the spring 35 (pressing part), even if an unintentional external force is applied to the link member 31 or the pressing lever 32Y, 32M, 32C, or 32K, a rotation of the pressing lever 32Y, 32M, 32C, or 32K and expansion and contraction of the spring 35 can prevent the pressing lever 32Y, 32M, 32C, or 32K and so on from being damaged.

The contact separation operation performed by the yellow, magenta, and cyan process units 10Y, 10M, and 10C is different from that performed by the black process unit 10K here, but the configuration is not limited to the one described here. For example, the contact separation operation performed by the process units of yellow, magenta, cyan, (and further black) may be different from that performed by the process unit which uses the special toner (such as the transparent toner).

Second Embodiment

Figure 13:
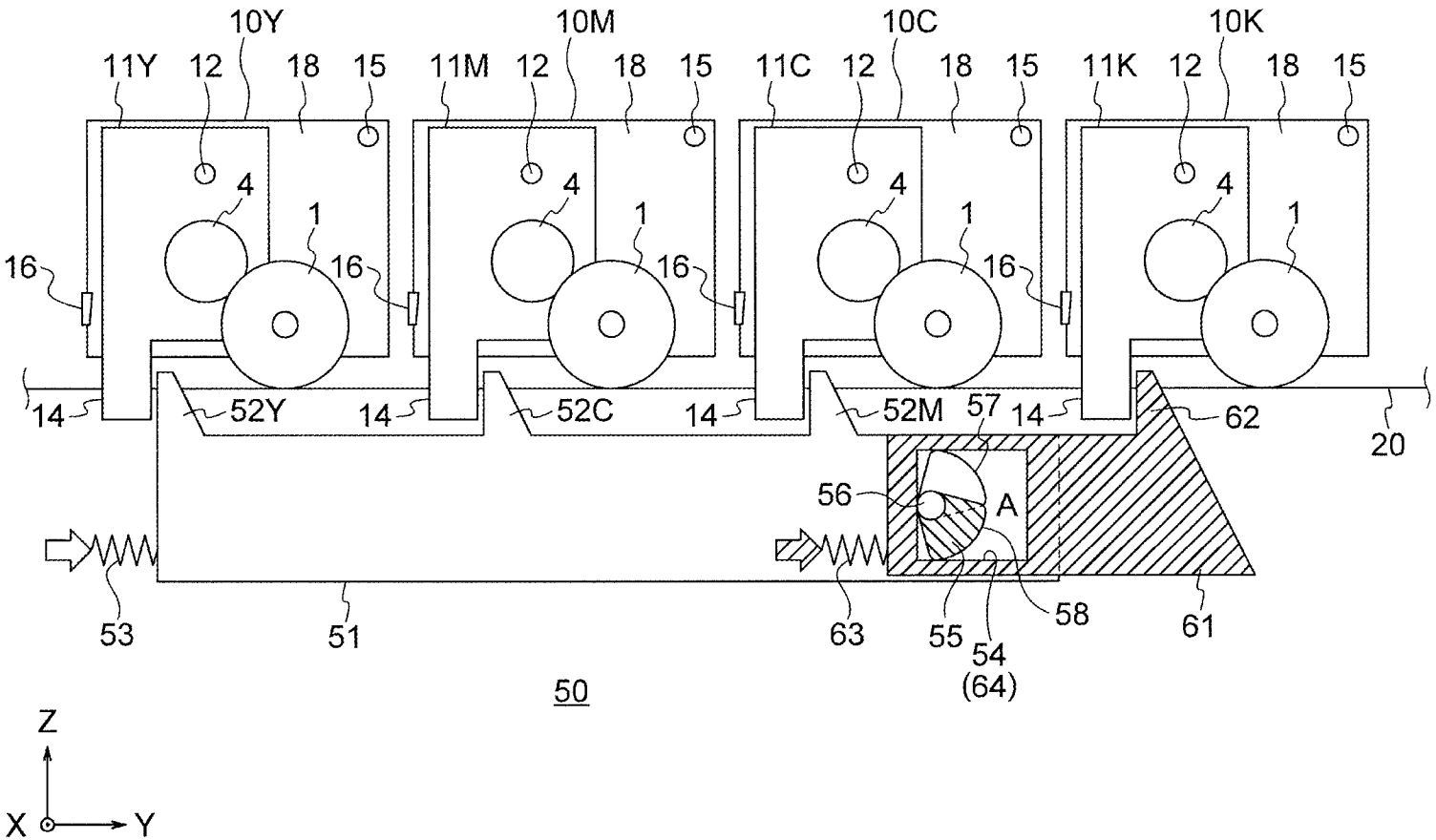
FIG. 13 is a schematic diagram showing process units and a contact-separation mechanism in a second embodiment.

A second embodiment of the present invention will next be described. FIG. 13 is a diagram showing process units 10Y, 10M, 10C, and 10K and a contact-separation mechanism 50 in the second embodiment. FIG. 13 shows also a part of an intermediate transfer belt 20. The configurations of the process units 10Y, 10M, 10C, and 10K are the same as described in the first embodiment.

The contact-separation mechanism 50 includes a first link member 51 and a second link member 61 that are movable in the Y direction along the process units 10Y, 10M, and 10C and a cam member 55 that moves them in the Y direction.

Figure 14:
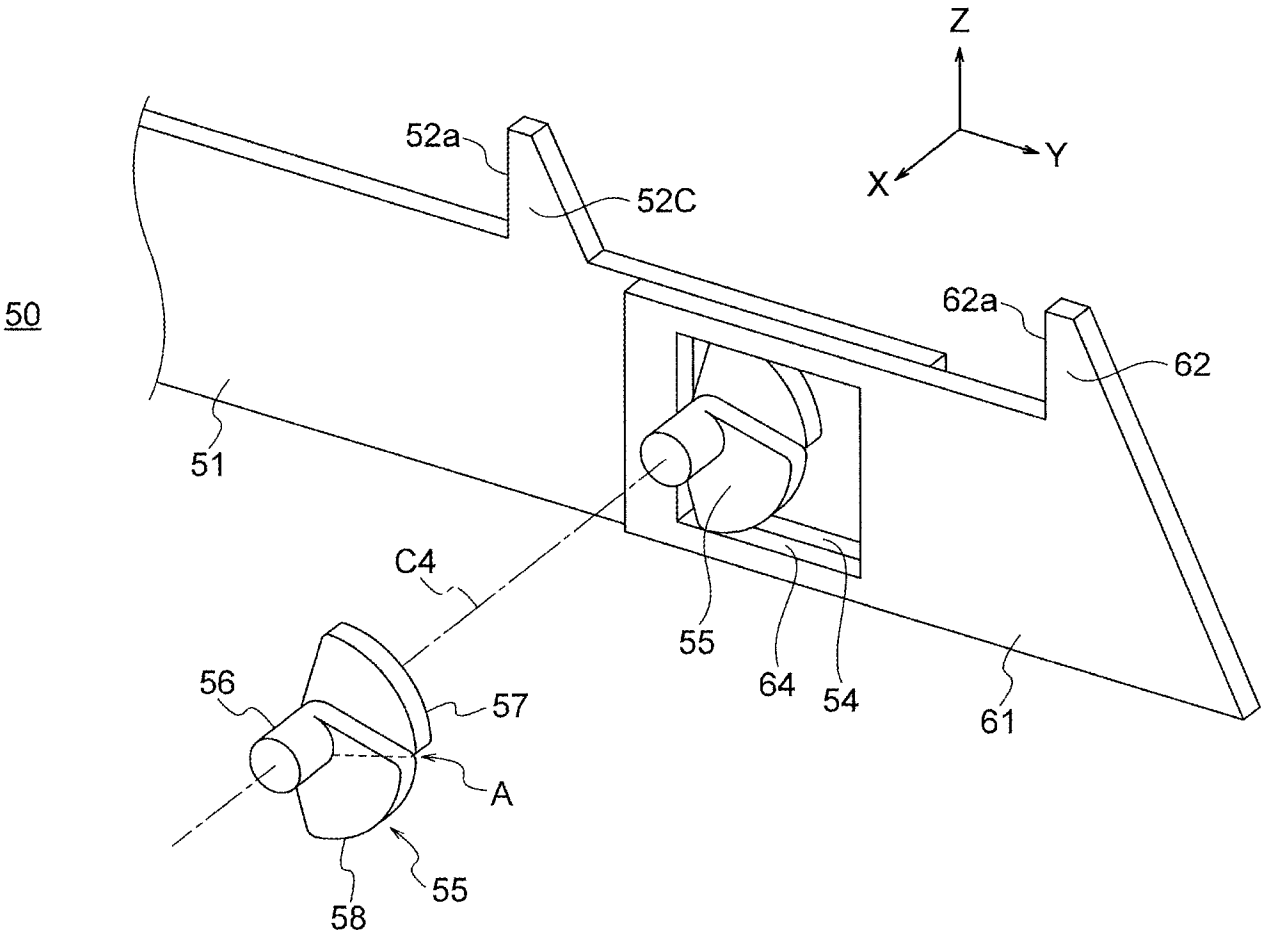
FIG. 14 is a perspective view showing a part of the contact-separation mechanism in the second embodiment.

The first link member 51 is a long-length plate-like member having adequate stiffness and has a length in the Y direction, a width in the Z direction, and a thickness in the X direction (see FIG. 14). Pressing sections 52Y, 52M, and 52C are formed so as to stick out in the upper part (+Z direction) of the first link member 51.

The pressing sections 52Y, 52M, and 52C are parts that press the working sections 14 of the developing units 11Y, 11M, and 11C. The pressing sections 52Y, 52M, and 52C are generically referred to as pressing sections 52 in some cases.

The second link member 61 is a long-length plate-like member having adequate stiffness and has a length in the Y direction, a width in the Z direction, and a thickness in the X direction (see FIG. 14). A pressing section 62 is formed so as to stick out in the upper part (+Z direction) of the second link member 61. The pressing section 62 is a part that presses the working section 14 of the developing unit 11K.

The first link member 51 is pressed in the +Y direction by a spring 53, which is a pressing part (first pressing member). The second link member 61 is pressed in the +Y direction by a spring 63, which is a pressing part (second pressing member).

FIG. 14 is a magnified perspective view which shows the first link member 51 and the second link member 61. The first link member 51 and the second link member 61 are disposed so as to be adjacent to each other in the X direction.

The first link member 51 includes a quadrangular opening 54. The opening 54 penetrates the first link member 51 in the direction of the thickness. The second link member 61 includes a quadrangular opening 64. The opening 64 penetrates the second link member 61 in the direction of the thickness.

The opening 54 of the first link member 51 and the opening 64 of the second link member 61 are disposed so as to overlap each other in the X direction. In the overlapping part of the opening 54 of the first link member 51 and the opening 64 of the second link member 61, the cam member 55 is disposed.

The cam member 55 includes a shaft section 56, with the shape of a cylinder of a radius r, extending in the X direction, and a first cam section 57 and a second cam section 58, with the shape of an arc of a radius R (>r), formed around the shaft section 56. C4 represents the central axial line of the shaft section 56.

Figure 15:
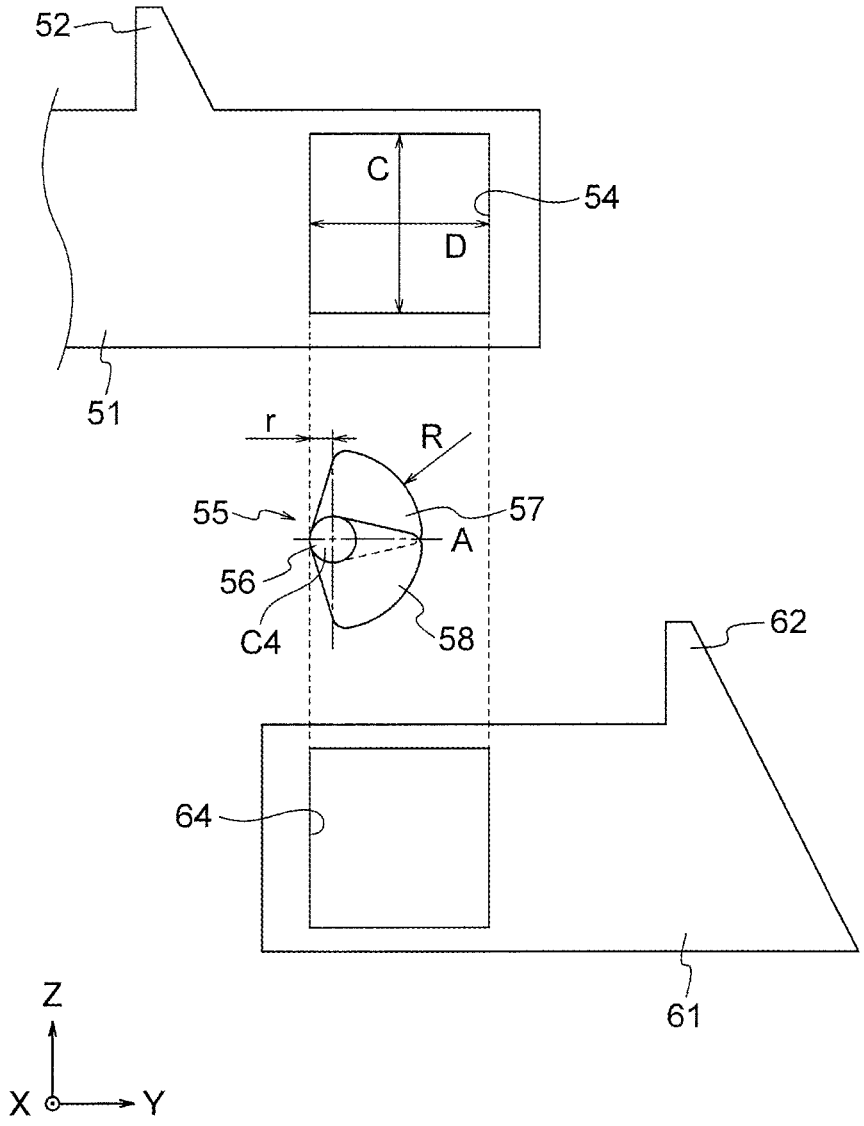
FIG. 15 is a schematic diagram showing a first link member, a second link member, and a cam member constituting the contact-separation mechanism in the second embodiment.

FIG. 15 is a schematic diagram which shows the shapes of the first link member 51, the second link member 61, and the cam member 55. The first cam section 57 and the second cam section 58 have an arc shape with an angle of 90 degrees with respect to the central axial line C4 of the shaft section 56.

The first cam section 57 and the second cam section 58 are placed with a phase difference of 90 degrees around the central axial line C4. The first cam section 57 and the second cam section 58 are adjacent to each other at boundary point A in the direction of rotation around the central axial line C4.

The cam member 55 is rotary-driven by the motor 81 (FIG. 11), for example. In this second embodiment, the rotation angle of the cam member 55 needs to be controlled accurately, and it is preferred that the motor 81 is a stepping motor.

The cam member 55 rotates inside the openings 54 and 64 of the link members 51 and 61. A state in which the cam sections 57 and 58 are placed in the +Y side of the shaft section 56, the first cam section 57 is higher (+Z side) than the second cam section 58, and the boundary point A is at the same height (position in the Z direction) as the central axial line C4 of the shaft section 56 is the reference position of the cam member 55.

Since the link members 51 and 61 are pressed respectively by the springs 53 and 63 (FIG. 13) in the +Y direction, when the cam member 55 is in its reference position, the shaft section 56 of the cam member 55 is in contact with the openings 54 and 64 of the link members 51 and 61. When the cam member 55 rotates counterclockwise from the reference position, the first cam section 57 presses the first link member 51 in the −Y direction. When the cam member 55 rotates clockwise from the reference position, the second cam section 58 presses the second link member 61 in the −Y direction.

The length of the cam member 55 in the Z direction becomes maximum (2×R) when the cam member 55 is in the reference position. Therefore, it is preferred that length C of the openings 54 and 64 in the Z direction is equal to or greater than (2×R+α), which is the maximum value (2×R) of the length of the cam member 55 in the Z direction plus clearance α.

Length D of the openings 54 and 64 in the Y direction determined by the maximum lengths of the cam sections 57 and 58 in the Y direction. According to a ratio between the radius r and the radius R described above, there is a case in which the length (R+r) of the cam sections 57 and 58 in the Y direction when the cam member 55 rotates by 45 degrees from the reference position, and there is a case in which the length (√2×R) of the cam sections 57 and 58 in the Y direction when the cam member 55 rotates by 90 degrees from the reference position. Therefore, it is preferred that the length D of the openings 54 and 64 in the Y direction is set to be equal to or greater than the larger one of √2×R and R+r.

The operation of the contact-separation mechanism 50 will next be described. FIG. 13 described above shows the process units 10Y, 10M, 10C, and 10K and the contact-separation mechanism 50 when the color printing is performed. In all the process units 10Y, 10M, 10C, and 10K, the developing roller 4 is in contact with the photosensitive drum 1, and the photosensitive drum 1 is in contact with the intermediate transfer belt 20. This state is referred to as the reference state of the process units 10Y, 10M, 10C, and 10K.

In the state shown in FIG. 13, the cam member 55 is in its reference position (rotation reference position) and is not pressing the first link member 51 and the second link member 61. Both the first link member 51 and the second link member 61 of the contact-separation mechanism 50 are placed in ends in the +Y direction of movable ranges. The pressing sections 52Y, 52M, and 52C of the first link member 51 are not in contact with the working sections 14 of the developing units 11Y, 11M, and 11C. The pressing section 62 of the second link member 61 is not in contact with the working section 14 of the developing unit 11K.

Figure 16:
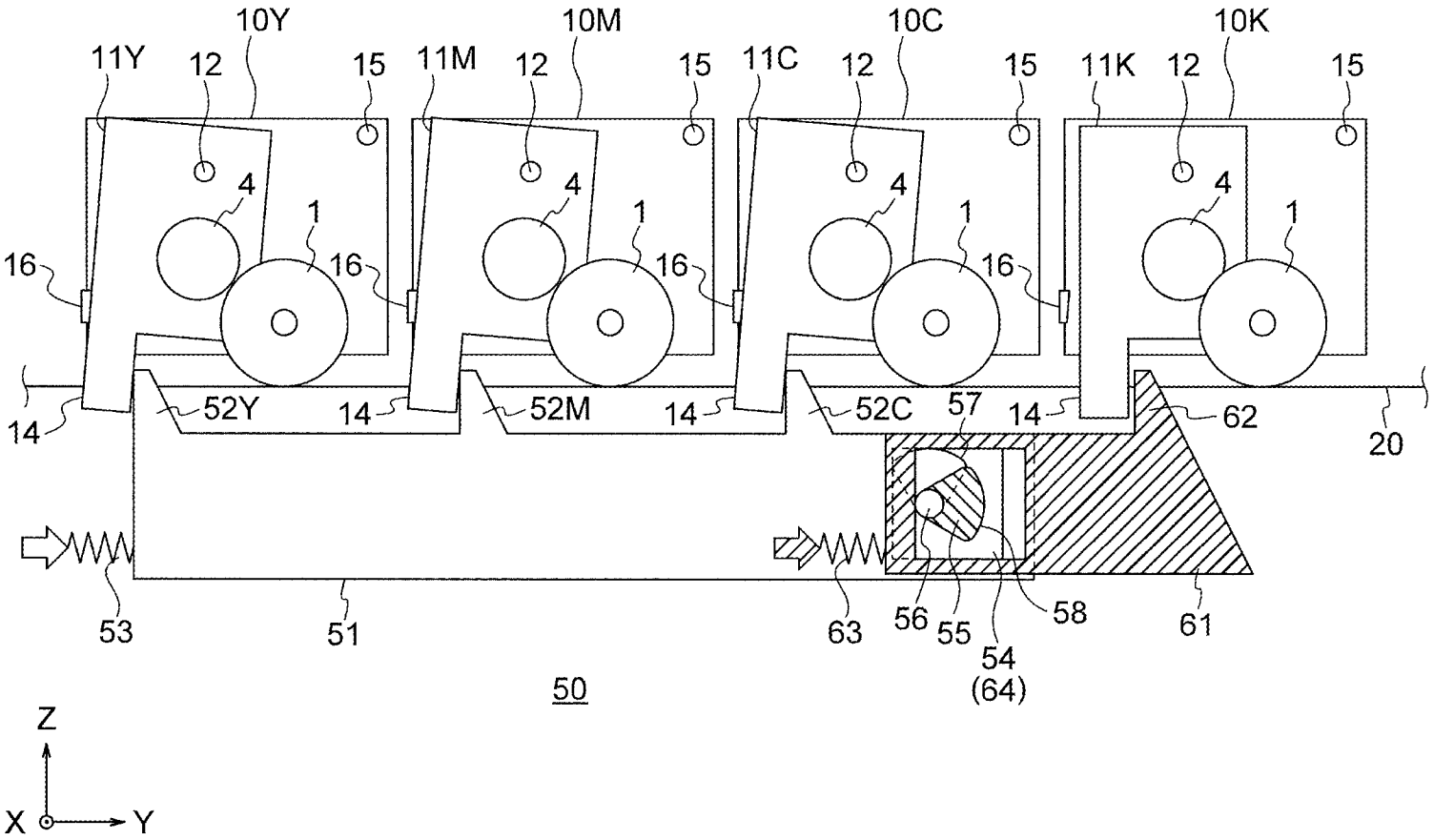
FIG. 16 is a diagram illustrating the operation of the contact-separation mechanism in the second embodiment.

FIG. 16 is a schematic diagram showing the process units 10Y, 10M, 10C, and 10K and the contact-separation mechanism 50 when the cam member 55 rotates counterclockwise by 45 degrees from the reference position. When the cam member 55 rotates counterclockwise by 45 degrees from the reference position, the first cam section 57 comes into contact with an inner rim of the opening 54 of the first link member 51 and presses the first link member 51 in the −Y direction. Consequently, the pressing sections 52Y, 52M, and 52C of the first link member 51 come into contact with the working sections 14 of the developing units 11Y, 11M, and 11C.

This causes the developing units 11Y, 11M, and 11C to rotate clockwise around the spindle 12 and the developing units 11Y, 11M, and 11C stop when they come into contact with the contact sections 16 of the process units 10Y, 10M, and 10C. In this state, in the process units 10Y, 10M, and 10C, the developing roller 4 is separated from the photosensitive drum 1, and the photosensitive drum 1 is in contact with the intermediate transfer belt 20.

Moreover, since the shaft section 56 of the cam member 55 is in contact with an inner rim of the opening 64 of the second link member 61, the second link member 61 does not move. Consequently, the pressing section 62 of the second link member 61 does not come into contact with the working section 14 of the developing unit 11K. That is, in the process unit 10K, the developing roller 4 is in contact with the photosensitive drum 1, and the photosensitive drum 1 is in contact with the intermediate transfer belt 20.

Figure 17:
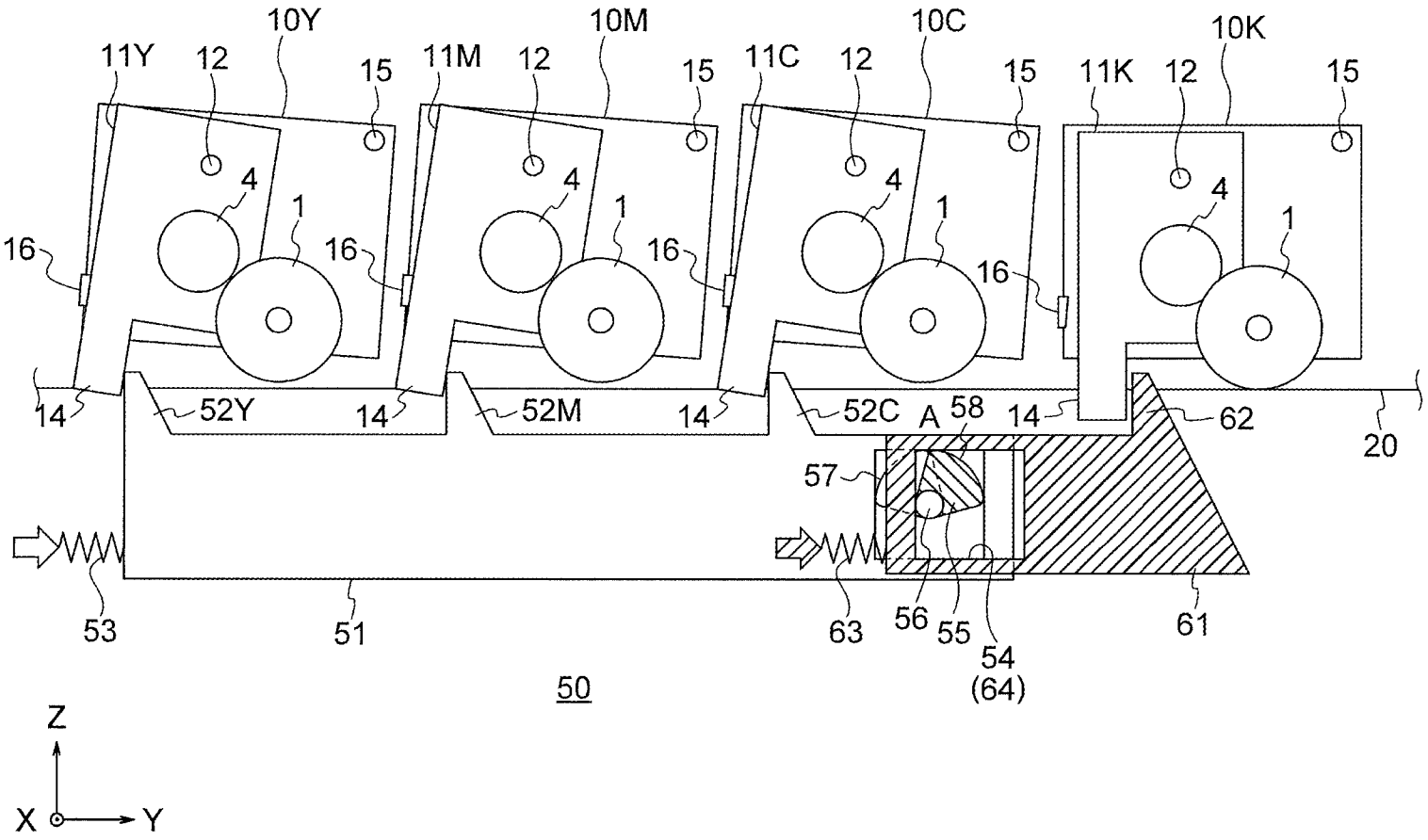
FIG. 17 is a diagram illustrating the operation of the contact-separation mechanism in the second embodiment.

FIG. 17 is a schematic diagram which shows the process units 10Y, 10M, 10C, and 10K and the contact-separation mechanism 50 when the cam member 55 rotates counterclockwise by 90 degrees from the reference position. When the cam member 55 rotates counterclockwise by 90 degrees from the reference position (that is, when the boundary point A of the cam member 55 faces in the +Z direction), the first cam section 57 moves the first link member 51 further in the −Y direction, and the first link member 51 moves to the position of distance R−r from the reference position.

Consequently, the pressing sections 52Y, 52M, and 52C of the first link member 51 press the working sections 14 of the developing units 11Y, 11M, and 11C further in the −Y direction, the developing units 11Y, 11M, and 11C rotate clockwise around the spindle 12, and (because of the contact between the developing units 11Y, 11M, and 11C and the contact sections 16) the process units 10Y, 10M, and 10C rotate clockwise around the spindle 15.

As a result, in the process units 10Y, 10M, and 10C, the developing roller 4 is separated from the photosensitive drum 1, and the photosensitive drum 1 is separated from the intermediate transfer belt 20.

On the other hand, since the shaft section 56 of the cam member 55 is in contact with the inner rim of the opening 64 of the second link member 61, the second link member 61 does not move. Consequently, the pressing section 62 of the second link member 61 does not come into contact with the working section 14 of the developing unit 11K. That is, in the process unit 10K, the developing roller 4 is in contact with the photosensitive drum 1, and the photosensitive drum 1 is in contact with the intermediate transfer belt 20.

Therefore, in the state shown in FIG. 17, the monochrome printing, in which the process unit 10K prints a black image, can be performed.

As described above, in the process units 10Y, 10M, and 10C, which are not used in the monochrome printing, the developing roller 4 is separated from the photosensitive drum 1, the photosensitive drum 1 is separated from the intermediate transfer belt 20, and thus the wearing out of the photosensitive drum 1 can be prevented.

To switch from the monochrome printing (FIG. 17) to the color printing (FIG. 13), it is sufficient that the cam member 55 is rotated clockwise by 90 degrees from the state shown in FIG. 17.

Figure 18:
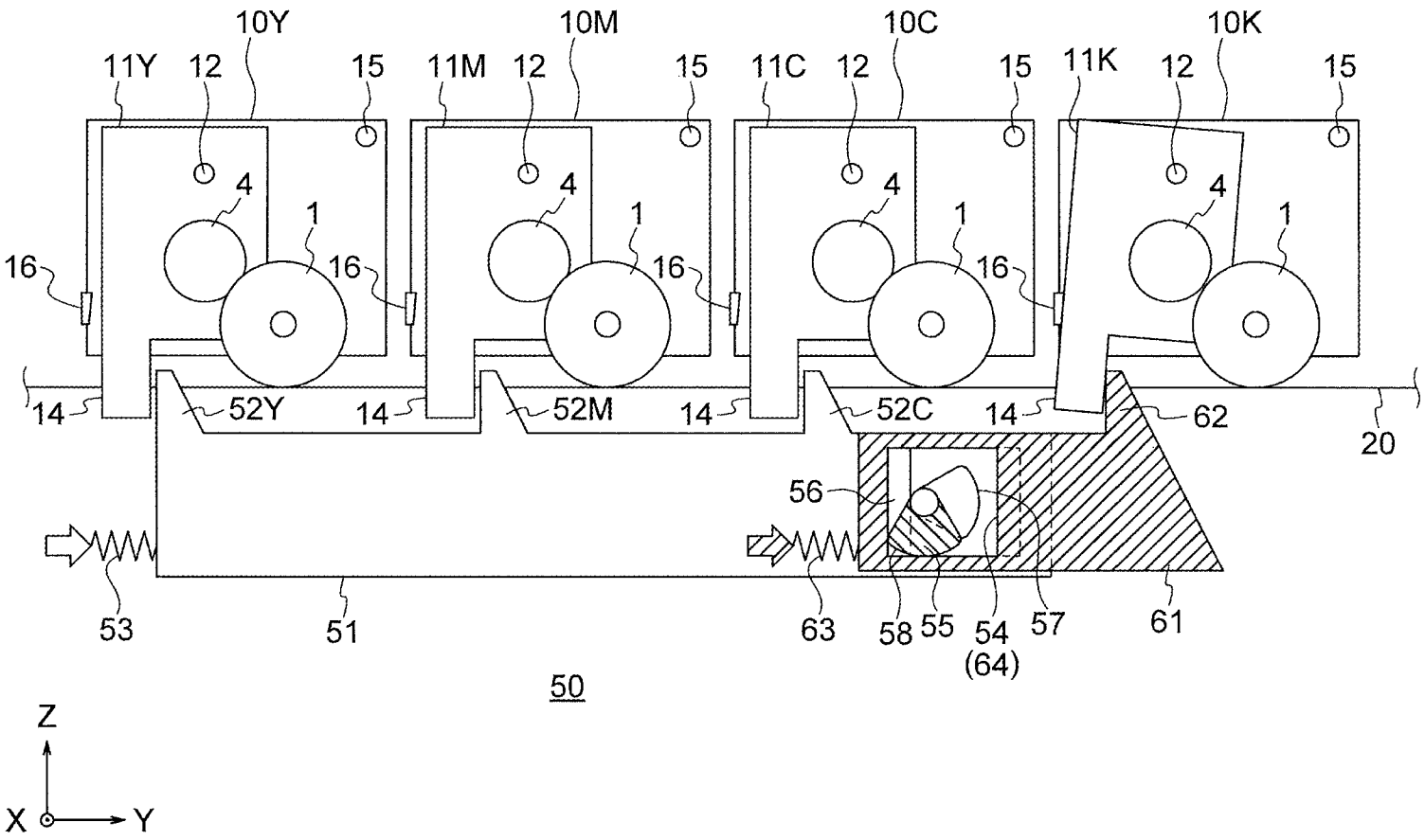
FIG. 18 is a diagram illustrating the operation of the contact-separation mechanism in the second embodiment.

FIG. 18 is a schematic diagram which shows the process units 10Y, 10M, 10C, and 10K and the contact-separation mechanism 50 when the cam member 55 rotates clockwise by 45 degrees from the reference position. When the cam member 55 rotates clockwise by 45 degrees from the reference position, the second cam section 58 comes into contact with the inner rim of the opening 64 of the second link member 61 and presses the second link member 61 in the −Y direction. Consequently, the pressing section 62 of the second link member 61 comes into contact with the working section 14 of the developing unit 11K.

As a result, the developing unit 11K rotates counterclockwise around the spindle 12 and stops rotating when it comes into contact with the contact section 16 of the process unit 10K. In this state, in the process unit 10K, the developing roller 4 is separated from the photosensitive drum 1, and the photosensitive drum 1 is in contact with the intermediate transfer belt 20.

Since the shaft section 56 of the cam member 55 is in contact with the inner rim of the opening 54 of the first link member 51, the first link member 51 does not move. Consequently, the pressing sections 52Y, 52M, and 52C of the first link member 51 do not come into contact with the working sections 14 of the developing units 11Y, 11M, and 11C. That is, in the process units 10Y, 10M, and 10C, the developing roller 4 is in contact with the photosensitive drum 1, and the photosensitive drum 1 is in contact with the intermediate transfer belt 20.

Figure 19:
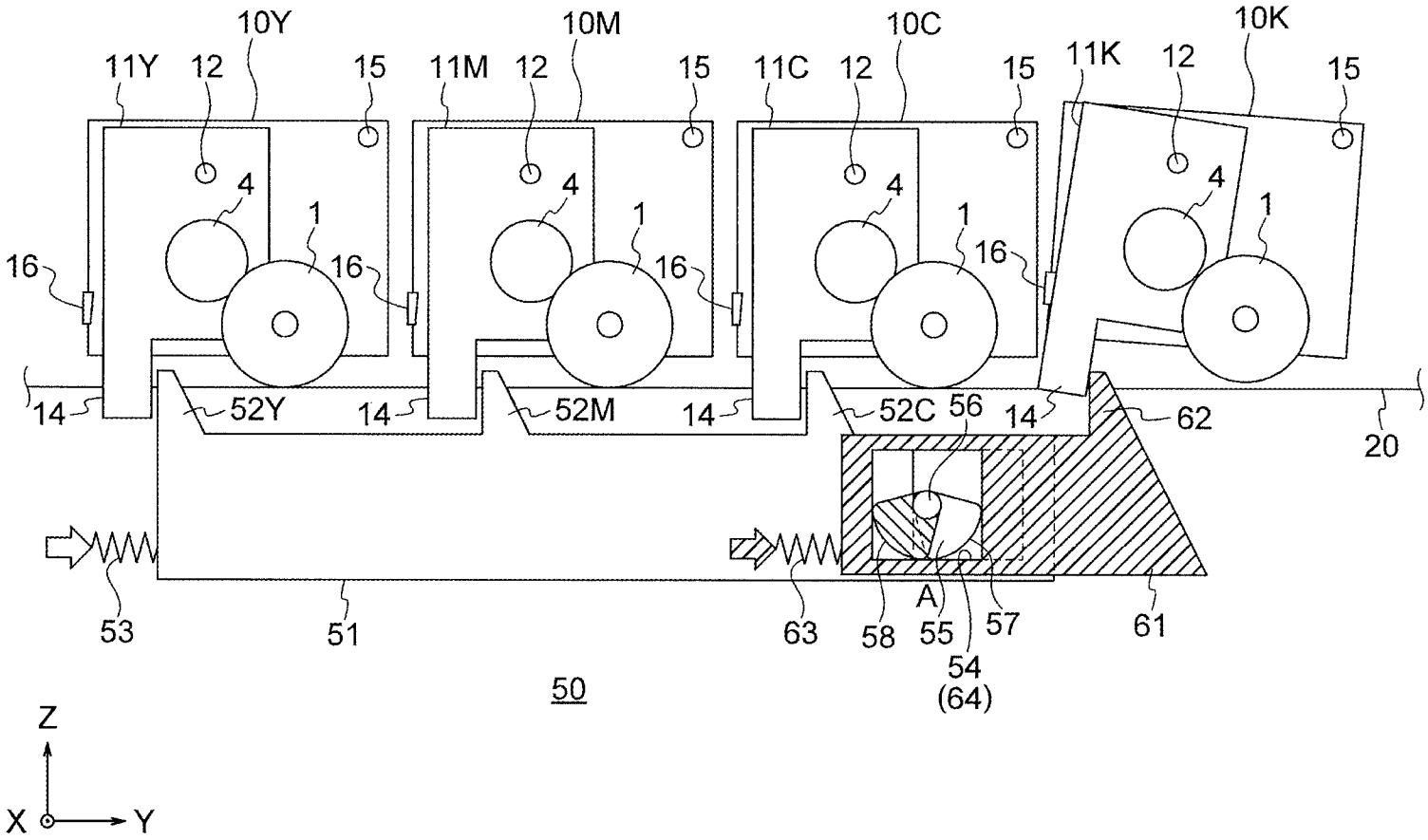
FIG. 19 is a diagram illustrating the operation of the contact-separation mechanism in the second embodiment.

FIG. 19 is a schematic diagram showing the process units 10Y, 10M, 10C, and 10K and the contact-separation mechanism 50 when the cam member 55 rotates clockwise by 90 degrees from the reference position. When the cam member 55 rotates clockwise by 90 degrees from the reference position (that is, when the boundary point A of the cam member 55 faces in the −Z direction), the second cam section 58 moves the second link member 61 in the −Y direction, and the second link member 61 moves to the position of distance R−r from the reference position.

Consequently, the pressing sections 52Y, 52M, and 52C of the first link member 51 press the working sections 14 of the developing units 11Y, 11M, and 11C further in the −Y direction, and the developing unit 11K rotates clockwise around the spindle 12. Because of the contact between the developing unit 11K and the contact section 16, the process unit 10K rotates clockwise around the spindle 15.

As a result, in the process unit 10K, the developing roller 4 is separated from the photosensitive drum 1, and the photosensitive drum 1 is separated from the intermediate transfer belt 20.

On the other hand, since the shaft section 56 of the cam member 55 is in contact with the inner rim of the opening 54 of the first link member 51, the first link member 51 does not move. Consequently, the pressing section 52 of the first link member 51 does not come into contact with the working sections 14 of the developing units 11Y, 11M, and 11C. That is, in the process units 10Y, 10M, and 10C, the developing roller 4 is in contact with the photosensitive drum 1, and the photosensitive drum 1 is in contact with the intermediate transfer belt 20.

Therefore, in the state shown in FIG. 19, YMC printing, in which the process units 10Y, 10M, and 10C print yellow, magenta, and cyan images, can be performed.

As has been described above, since in the process unit 10K the developing roller 4 is separated from the photosensitive drum 1 and the photosensitive drum 1 is separated from the intermediate transfer belt 20, the wearing out of the photosensitive drum 1 of the process unit 10K, which is not used in the YMC printing, can be prevented.

When the YMC printing (FIG. 19) is switched to the color printing (FIG. 13), it is sufficient that the cam member 55 is rotated counterclockwise by 90. When the monochrome printing (FIG. 17) is switched to the YMC printing (FIG. 19), it is sufficient that after it is returned to the state shown in FIG. 13 (the color printing) it is switched to the state shown in FIG. 19.

Figure 20:
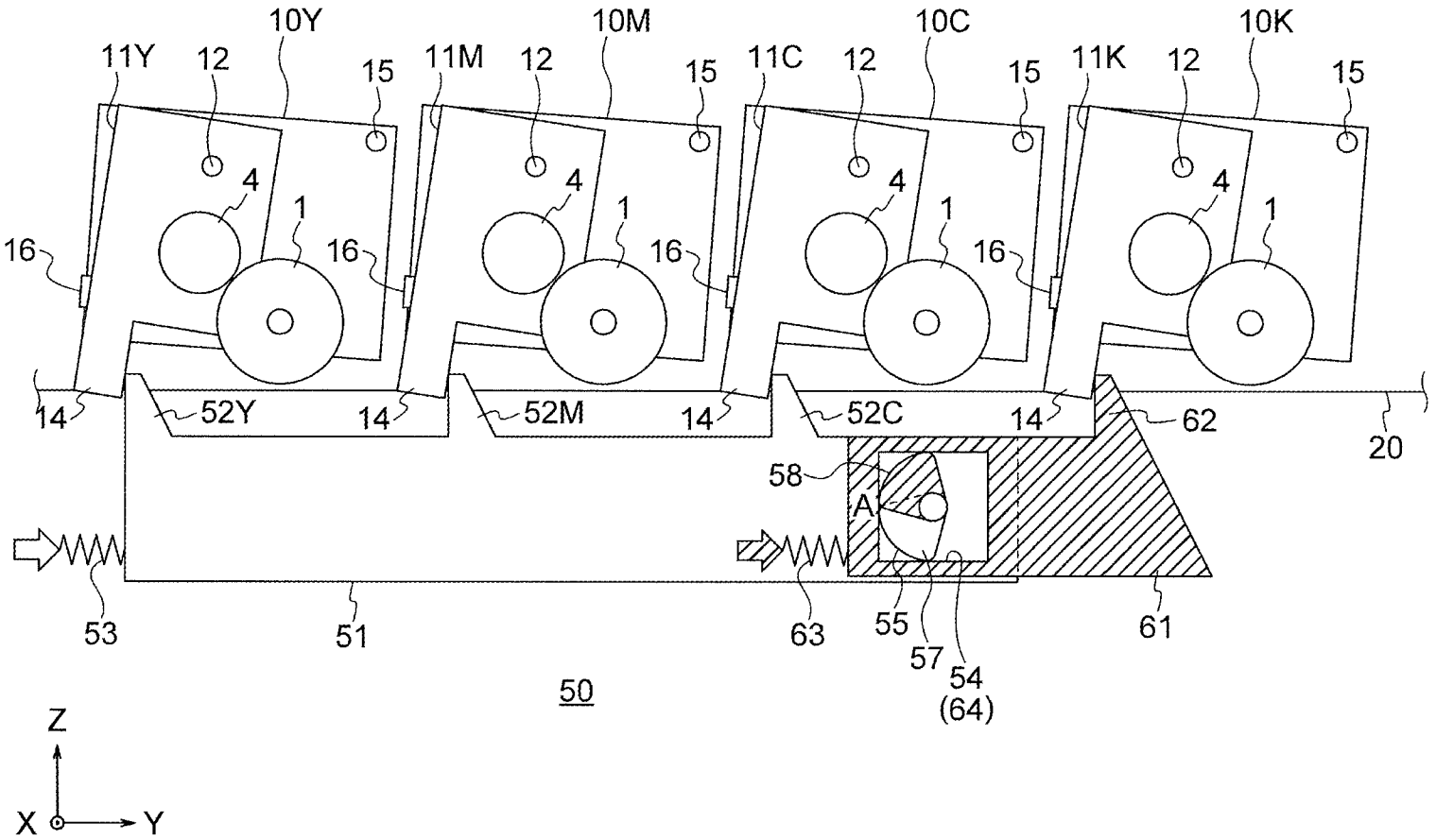
FIG. 20 is a diagram illustrating the operation of the contact-separation mechanism in the second embodiment.

FIG. 20 is a schematic diagram which shows the process units 10Y, 10M, 10C, and 10K and the contact-separation mechanism 50 when the cam member 55 rotates by 180 degrees clockwise or counterclockwise from the reference position. When the cam member 55 rotates by 180 degrees from the reference position (that is, when the boundary point A of the cam member 55 faces in the −Y direction), the cam sections 57 and 58 into contact with the inner rims of the openings 54 and 64 of the link members 51 and 61, moves the link members 51 and 61 in the −Y direction, and the link members 51 and 61 move to the positions of distance R−r from the reference position.

Consequently, the pressing sections 52Y, 52M, 52C, and 62 of the link members 51 and 61 press the working sections 14 of the developing units 11Y, 11M, 11C, and 11K in the −Y direction, and the developing units 11Y, 11M, 11C, and 11K rotate clockwise around the spindle 12. Because of the contact between the developing units 11Y, 11M, 11C, and 11K and the contact sections 16, the process units 10Y, 10M, 10C, and 10K rotate clockwise around the spindle 15.

As a result, in all the process units 10Y, 10M, 10C, and 10K, the developing roller 4 is separated from the photosensitive drum 1, and the photosensitive drum 1 is separated from the intermediate transfer belt 20. In this state, the image forming apparatus 100 stops printing and can enter a sleep mode, for example.

As described here, in all the process units 10Y, 10M, 10C, and 10K, the developing roller 4 is separated from the photosensitive drum 1, and the photosensitive drum 1 is separated from the intermediate transfer belt 20, and therefore even if the image forming apparatus 100 is left unused for a long period of time, the surface of the developing roller 4 is kept free of indentation. The deterioration of toner resulting from the transfer of toner from the developing roller 4 to the photosensitive drum 1 can also be suppressed.

The other configuration and operation of the image forming apparatus of the second embodiment are the same as those of the image forming apparatus of the first embodiment.

(Effects of Second Embodiment)

As has been described above, in the second embodiment of the present invention, the contact-separation mechanism 50 includes the first link member 51 that includes the pressing sections 52Y, 52M, and 52C (first pressing section), the second link member 61 that includes the pressing section 62 (second pressing section), and the cam member 55 that moves these link members 51 and 61. Consequently, the developing roller 4 not in use can be separated from the photosensitive drum, and the photosensitive drum 1 can be separated from the intermediate transfer belt 20. As a result, with the simple configuration, the deformation of the developing roller 4 and the wearing out of the photosensitive drum 1 can be suppressed, and the deterioration of the toner T can be suppressed.

Since by using the common cam member 55, in the process units 10Y, 10M, 10C, and 10K, the developing roller 4 and the photosensitive drum 1 can be brought into contact with each other and be separated from each other, and the photosensitive drums 1 and the intermediate transfer belt 20 can be brought into contact with each other and be separated from each other, the configuration of the contact-separation mechanism 50 is simplified. In addition, since the contact-separation mechanism 50 needs just a single driving source, it can also be easily controlled.

Since the cam member 55 includes the first cam section 57 that comes into contact with the first link member 51 and the second cam section 58 that comes into contact with the second link member 61, a configuration of moving the two link members 51 and 61 by rotating the single cam member 55 can be achieved.

Since the cam member 55 comes into contact with the inner rim of the opening 54 of the first link member 51 and the inner rim of the opening 64 of the second link member 61 and the openings 54 and 64 are formed so as to overlap each other, the lengths of the link members 51 and 61 in the Y direction can be reduced comparatively, and the space occupied by the contact-separation mechanism 50 can be reduced.

According to the rotation position of the cam member 55, the state (FIG. 17) in which the pressing sections 52Y, 52M, and 52C of the first link member 51 are pressing the working sections 14 of the developing units 11Y, 11M, and 11C while the pressing section 62 of the second link member 61 is not pressing the working section 14 of the developing unit 11K, the state (FIG. 20) in which the pressing sections 52Y, 52M, 52C, and 62 of the link members 51 and 61 are pressing the working sections 14 of the developing units 11Y, 11M, 11C, and 11K, and the state (FIG. 13) in which the pressing sections 52Y, 52M, 52C, 62 of the link members 51 and 61 are not pressing the working sections 14 of the developing units 11Y, 11M, 11C, and 11K can be taken. Consequently, with the rotation of the cam member 55, the contact separation state between the developing rollers 4 and the photosensitive drums 1 and the contact separation state between the photosensitive drums 1 and the intermediate transfer belt 20 can be switched, according to whether the color printing or the monochrome printing is performed or whether the printing is stopped.

According to the rotation position of the cam member 55, the state (FIG. 19) in which the pressing sections 52Y, 52M, and 52C of the first link member 51 are not pressing the working sections 14 of the developing units 11Y, 11M, and 11C while the pressing section 62 of the second link member 61 is pressing the working section 14 of the developing unit 11K can be taken, and thus the YMC printing which forms images of colors other than black, for example, can be performed.

Here, the contact-separation operation performed in the yellow, magenta, and cyan process units 10Y, 10M, and 10C differs from that in the black process unit 10K, but the configuration is not limited to the one described here. For example, the contact separation operation performed by the yellow, magenta, cyan, (and further black) process units may be different from that performed by the process unit which uses the special toner (such as the transparent toner).

In the configuration described here, the three print modes (operation states) of the color printing, the monochrome printing, and the YMC printing can be taken. However, just two out of these print modes may be taken, or four or more print modes may be taken.

Modification

Figure 21:
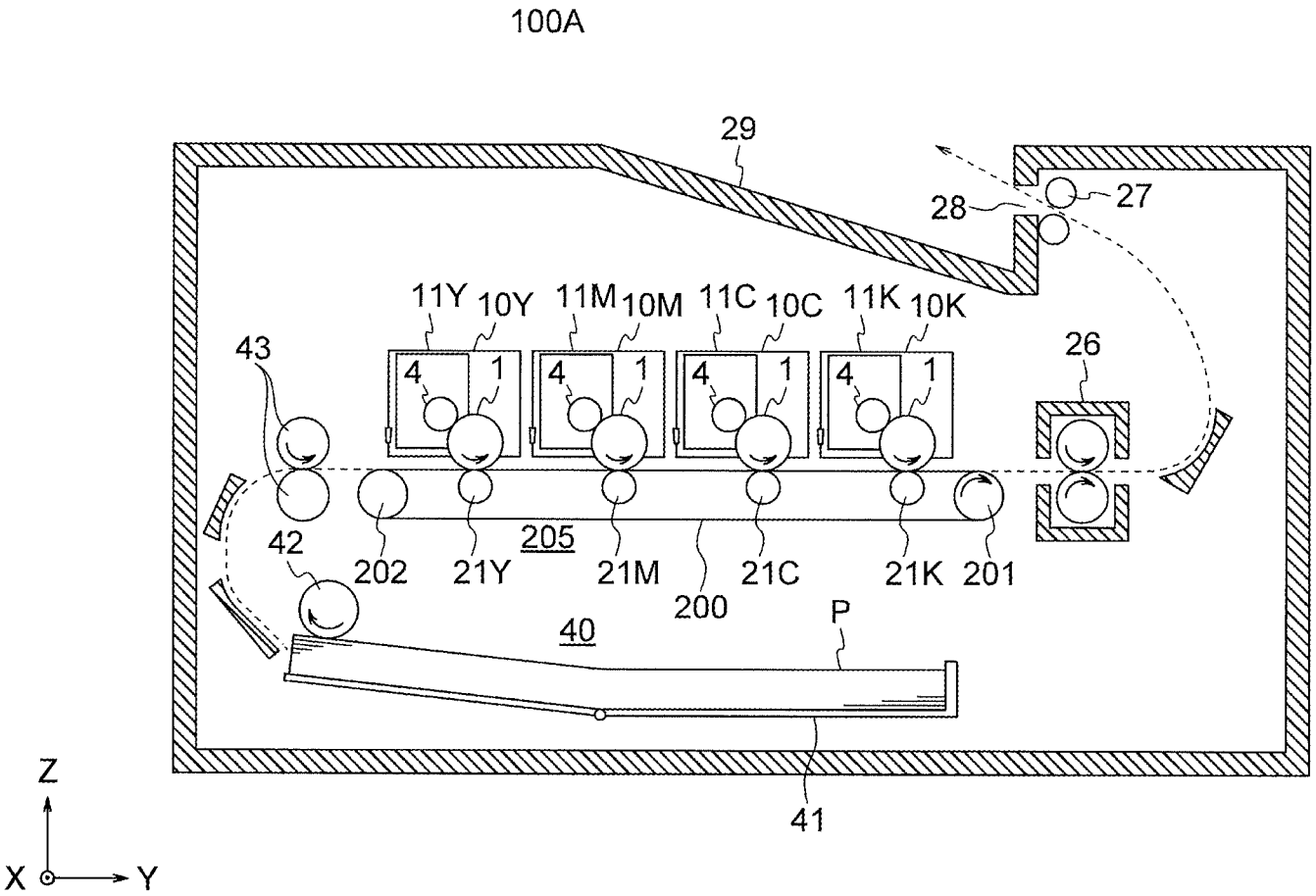
FIG. 21 is a diagram showing an image forming apparatus of a modification of the first and second embodiments.

FIG. 21 is a diagram showing an image forming apparatus 100A of a modification of the first and second embodiments. The image forming apparatus 100 of the first and second embodiments uses the intermediate transfer system, but the image forming apparatus 100A of the modification uses a direct transfer system.

The image forming apparatus 100 includes a medium supply section 40 that supplies a recording medium P, process units 10Y, 10M, 10C, and 10K that form an image, a transfer unit 205 that transfers the image to the recording medium P, a fixing device 26 that fixes the image onto the recording medium P, and ejection rollers 27 that discharge the recording medium P. The medium supply section 40, the fixing device 26, and the ejection rollers 27 are configured as described in the first embodiment.

The process units 10Y, 10M, 10C, and 10K are arranged here in a row from the left to the right in the figure. The process units 10Y, 10M, 10C, and 10K are configured as described in the first embodiment.

The transfer unit 205 includes a transfer belt 200 as a transfer body and inside the transfer belt 200, includes transfer rollers 21Y, 21M, 21C, and 21K, a driving roller 201, and a driven roller 202.

The driving roller 201 is rotary-driven by a belt drive motor and moves the transfer belt 200 in a direction represented by arrow B. The driven roller 202 gives tension to the intermediate transfer belt 20. The transfer belt 200 holds the recording medium P on its surface and conveys it along the process units 10Y, 10M, 10C, and 10K. A transfer voltage is applied to the transfer rollers 21Y, 21M, 21C, and 21K to transfer the toner images on the photosensitive drums 1 onto the recording medium P.

In the process units 10Y, 10M, 10C, and 10K, the contact-separation mechanism 30 described in the first embodiment or the contact-separation mechanism 50 described in the second embodiment can bring the developing roller 4 and the photosensitive drum 1 into contact with each other and separate them from each other, and bring the photosensitive drum 1 and the transfer belt 200 into contact with each other and separate them from each other.

An electrophotographic printer has been described in the embodiments and modification described above, but the present invention is not limited to that and can also be applied to electrophotographic facsimile, copiers, multi-functional peripherals (MFPs), for example.

The image forming apparatus described in the embodiments and modification described above includes a plurality of process units, but the preset invention is limited to that and can also be applied to an image forming apparatus including a single process unit, for example. Even in that case, the contact-separation mechanism brings the developer carrier and the image carrier into contact with each other and separates them from each other and brings the image carrier and the transfer body into contact with each other and separates them from each other, and thereby the effects of suppressing the deformation of the developer carrier and the wearing out of the image carrier with the simple configuration can be obtained.

The invention being thus described, it will be obvious that the same may be varied in many ways. Such variations are not to be regarded as a departure from the spirit and scope of the invention, and all such modifications as would be obvious to one skilled in the art are intended to be included within the scope of following claims.

What is claimed is:

1. An image forming apparatus comprising:

an image carrier;

a developer carrier disposed so as to face the image carrier;

a transfer body disposed so as to face the image carrier;

a contact-separation mechanism configured to bring the developer carrier and the image carrier into contact with each other and separate the developer carrier and the image carrier from each other, the contact-separation mechanism being configured to bring the image carrier and the transfer body into contact with each other and separate the image carrier and the transfer body from each other;

a frame;

a process unit that is rotatably mounted on the frame and includes the image carrier; and a developing unit that is rotatably mounted on the process unit and includes the developer carrier;

wherein the contact-separation mechanism brings the developer carrier into contact with the image carrier and separates the developer carrier from the image carrier by rotating the developing unit with respect to the process unit, and brings the image carrier into contact with the transfer body and separates the image carrier from the transfer body by rotating the process unit with respect to the frame.

2. The image forming apparatus according to claim 1, wherein the contact-separation mechanism separates the developer carrier from the image carrier by rotating the developing unit by a predetermined angle in a predetermined direction from a state in which the developer carrier is in contact with the image carrier and, separates the image carrier from the transfer body by rotating the process unit in the predetermined direction in conjunction with the developing unit after the developing unit reaches the predetermined angle.

3. The image forming apparatus according to claim 1, wherein the image carrier is provided rotatably around a predetermined rotation axis; and the process unit and the developing unit is provided rotatably around a rotation axis parallel to the predetermined rotation axis.

4. The image forming apparatus according to claim 1, wherein the developing unit includes a first developing unit and a second developing unit each including the developer carrier;

the process unit includes a first process unit and a second process unit each including the image carrier; and the contact-separation mechanism includes a first pressing section configured to press the first developing unit and a second pressing section configured to press the second developing unit.

5. The image forming apparatus according to claim 4, wherein the contact-separation mechanism includes a movable link member including the first pressing section and the second pressing section, and takes, according to a position of the link member, a first state in which the first pressing section is pressing the first developing unit while the second pressing section is not pressing the second developing unit, a second state in which the first pressing section is pressing the first developing unit while the second pressing section is pressing the second developing unit, and a third state in which the first pressing section is not pressing the first developing unit while the second pressing section is not pressing the second developing unit.

6. The image forming apparatus according to claim 5, wherein the link member is movable in a direction in which the first process unit and the second process unit are arranged; and spacing between the second pressing section and the second developing unit is wider in the direction of movement of the link member than spacing between the first pressing section and the first developing unit.

7. The image forming apparatus according to claim 5, wherein the first pressing section and the second pressing section are rotatably mounted on the link member; and, the contact-separation mechanism includes:

a pressing part configured to press the first pressing section and the second pressing section respectively toward the first developing unit and the second developing unit; and a rotation regulation section configured to regulate rotation ranges of the first pressing section and the second pressing section.

8. The image forming apparatus according to claim 5, further comprising a driving source configured to move the link member.

9. The image forming apparatus according to claim 4, wherein the contact-separation mechanism includes:

a first link member including the first pressing section;

a second link member including the second pressing section; and a cam member configured to move the first link member and the second link member.

10. The image forming apparatus according to claim 9, wherein a first state in which the first pressing section is pressing the first developing unit while the second pressing section is not pressing the second developing unit, a second state in which the first pressing section is pressing the first developing unit while the second pressing section is pressing the second developing unit, and a third state in which the first pressing section is not pressing the first developing unit while the second pressing section is not pressing the second developing unit are taken, according to a position of the cam member.

11. The image forming apparatus according to claim 10, wherein a fourth state in which the first pressing section is not pressing the first developing unit while the second pressing section is pressing the second developing unit is taken, further, according to the position of the cam member.

12. The image forming apparatus according to claim 9, wherein the cam member includes:

a first cam section configured to come into contact with the first link member; and a second cam section configured to come into contact with the second link member.

13. The image forming apparatus according to claim 12, wherein the first cam section comes into contact with an inner rim of an opening formed in the first link member;

the second cam section comes into contact with an inner rim of an opening formed in the second link member; and the opening of the first link member and the opening of the second link member overlap each other at least partly.

14. The image forming apparatus according to claim 13, further comprising a pressing part configured to press the first link member and the second link member so that the cam member is pressed.

15. The image forming apparatus according to claim 9, further comprising a driving source configured to rotate the cam member.

16. The image forming apparatus according to claim 4, wherein the first developing unit includes at least one developer of yellow, magenta, and cyan; and the second developing unit includes a black developer.

17. An image forming apparatus comprising:

an image carrier;

a developer carrier disposed so as to face the image carrier;

a transfer body disposed so as to face the image carrier;

a contact-separation mechanism configured to bring the developer carrier and the image carrier into contact with each other and separate the developer carrier and the image carrier from each other, the contact-separation mechanism being configured to bring the image carrier and the transfer body into contact with each other and separate the image carrier and the transfer body from each other;

a frame;

a process unit that is pivotably mounted on the frame and includes the image carrier; and a developing unit that is pivotably mounted on the process unit and includes the developer carrier;

wherein the contact-separation mechanism brings the developer carrier into contact with the image carrier and separates the developer carrier from the image carrier by pivoting the developing unit with respect to the process unit, and brings the image carrier into contact with the transfer body and separates the image carrier from the transfer body by pivoting the process unit with respect to the frame.

* * * * *